US012270615B1

(12) United States Patent
Trout

(10) Patent No.: US 12,270,615 B1
(45) Date of Patent: Apr. 8, 2025

(54) STAKING FIXTURE

(71) Applicant: Disruptive Machine LLC, Boise, ID (US)

(72) Inventor: Aaron Neal Trout, Boise, ID (US)

( * ) Notice: Subject to any disclaimer, the term of this patent is extended or adjusted under 35 U.S.C. 154(b) by 0 days.

(21) Appl. No.: 18/406,903

(22) Filed: Jan. 8, 2024

Related U.S. Application Data

(60) Provisional application No. 63/438,486, filed on Jan. 11, 2023.

(51) Int. Cl.
*F41A 11/00* (2006.01)

(52) U.S. Cl.
CPC ..... *F41A 11/00* (2013.01)

(58) Field of Classification Search
CPC ..... F41A 11/00; F41A 21/48; F41A 35/00; B25B 13/48
USPC ..... 42/108
See application file for complete search history.

(56) References Cited

U.S. PATENT DOCUMENTS

D19,637 S * 2/1890 Rivett ..... D8/51
537,382 A * 4/1895 Branson ..... G04D 1/08 29/232
992,206 A * 5/1911 Kendrick ..... G04D 3/04 29/231
1,397,614 A * 11/1921 Bary ..... G04D 1/022 29/232
2,364,420 A * 12/1944 Bloss ..... B21J 15/24 173/100
2,372,973 A * 4/1945 Robert ..... B25D 17/005 81/463
2,421,310 A * 5/1947 Berlincourt ..... G04D 3/042 968/736
2,713,279 A * 7/1955 Harris ..... H01R 43/042 81/391
3,492,854 A * 2/1970 Eppler ..... H01R 43/042 254/106
3,630,068 A * 12/1971 Floyd, Jr. ..... H01R 43/042 81/367
D598,723 S * 8/2009 Cheng ..... D8/17
D703,502 S * 4/2014 Cheng ..... D8/21
D791,558 S * 7/2017 Carpio ..... D8/1
11,549,776 B2 * 1/2023 Jacobson ..... B25B 13/48
2013/0036648 A1 * 2/2013 Shipman ..... F41C 23/16 42/108
2015/0198405 A1 * 7/2015 Keng ..... F41A 11/00 42/108
2015/0290780 A1 * 10/2015 Bennett ..... B25B 13/04 81/121.1
2016/0201713 A1 * 7/2016 Dolan ..... F16B 39/108 81/54
2019/0285377 A1 * 9/2019 Jacobson ..... B25B 13/48

OTHER PUBLICATIONS

Patrick R; Review: Michiguns MOACKS Plain Gas Key Staking Tool; Feb. 20, 2017; The Firearm Blog; https://www.thefirearmblog.com/blog/2017/02/20/michiguns-moacks-plain-gas-key-tool/ (Year: 2017).*

* cited by examiner

*Primary Examiner* — Joshua E Freeman

(57) ABSTRACT

A staking fixture is disclosed. The staking fixture contains a front surface, a rear surface, an opening, a plurality of protrusions extending into the opening, and a forward protrusion extending away from the front surface, wherein the forward protrusion contains an aperture configured to accommodate a staking punch.

4 Claims, 35 Drawing Sheets

Text

STAKING FIXTURE

CROSS REFERENCE TO RELATED APPLICATIONS

This application claims the benefit of U.S. Provisional Application No. 63/438,486, filed on Jan. 11, 2023, which is incorporated herein by reference in its entirety.

FIELD

The present invention relates to firearm manufacture. More particularly, the present invention relates to a staking fixture for assembly of a firearm.

BACKGROUND

The AR15/M16 family of firearms and their derivatives, have butt stocks that are attached to the weapon by means of a tube which projects from the rear of the weapon, known as the buffer tube. The buffer tube is secured with the firearm using a castle nut. Although castle nut retains the buffer tube in proper alignment during normal operations, this is not the case if the firearm is dropped or hit against a wall. An impact may cause the castle nut to rotate and loosen the buffer tube from the firearm. This could lead to catastrophic failure of the firearm.

Accordingly, a need exists for improvements that addresses the foregoing and other related and unrelated problems in the art.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
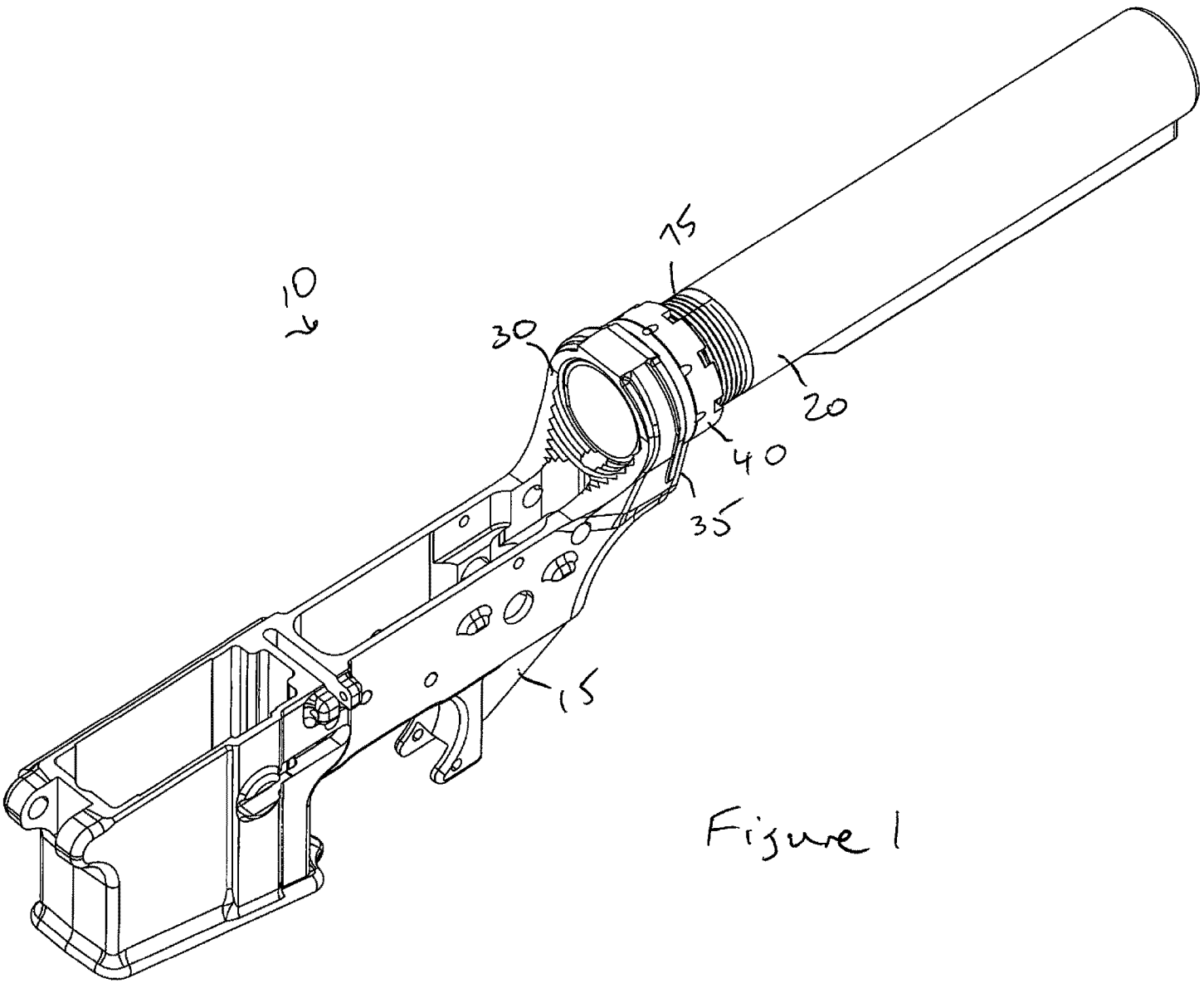
FIG. 1 depicts a partial view of a firearm according to some embodiments presently disclosed.
Figure 2:
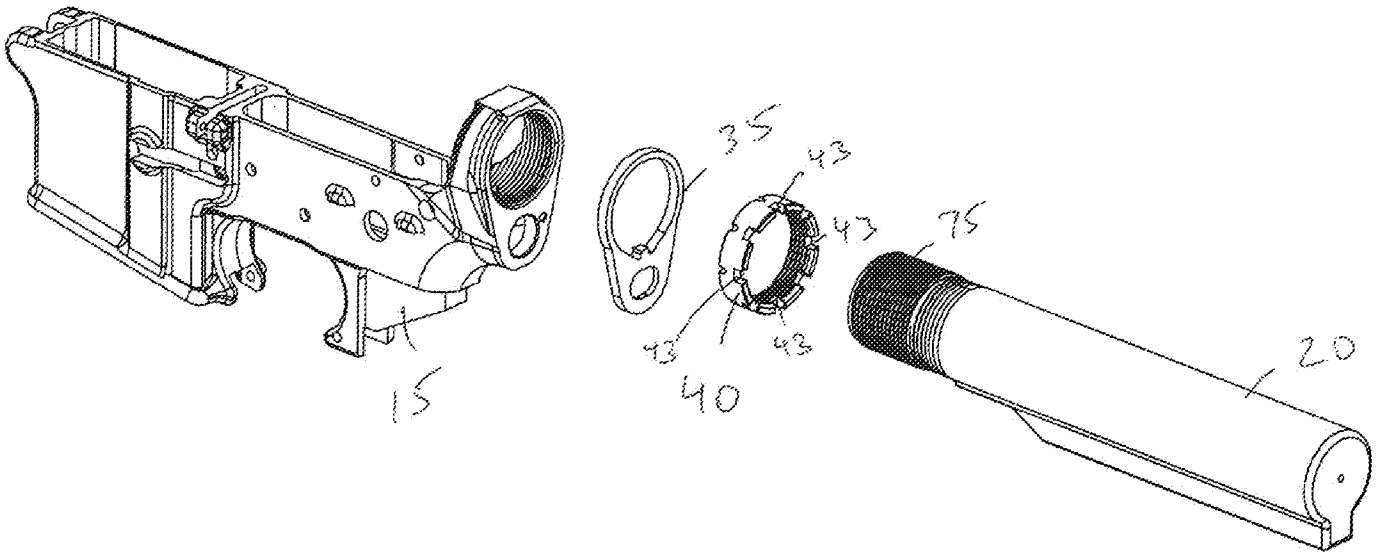
FIG. 2 depicts an exploded view of the firearm according to some embodiments presently disclosed.

Referring to FIG. 1, an assembled, partial view of a firearm 10 is shown according to some embodiments presently disclosed. Referring to FIG. 2, an exploded, partial view of the firearm 10 is shown according to some embodiments presently disclosed. The firearm 10 may comprise a lower receiver 15.

The lower receiver 15 comprises an upwardly extending lobe 30. According to some embodiments, the upwardly extending lobe 30 is used to mount a buttstock (not shown) to the lower receiver 15 and is used to align a receiver extension (i.e. buffer tube) 20 with a bolt carrier (not shown) housed within an upper receiver (not shown). The receiver extension 20 generally houses an action (or recoil) spring (not shown) and a buffer assembly (not shown). Upon discharge of a round, the bolt carrier within the upper receiver is driven rearward by action of the gas discharged by the firing action. The buffer assembly and the action spring dampen the kickback experienced by a user while also redirecting the firing mechanism back toward the chamber in preparation for firing another round. The buffer tube 20 comprises an external thread 75 for coupling the buffer tube 20 with the upwardly extending lobe 30.

The firearm 10 may also comprise an end plate 35 and a castle nut 40 for aligning and coupling the receiver extension 20 with the lower receiver 15. According to some embodiments presently disclosed, the end plate 35 is positioned between the lobe 30 and the castle nut 40. According to some embodiments presently disclosed, the end plate 35 is sandwiched between the lobe 30 and the castle nut 40.

Figure 4A:
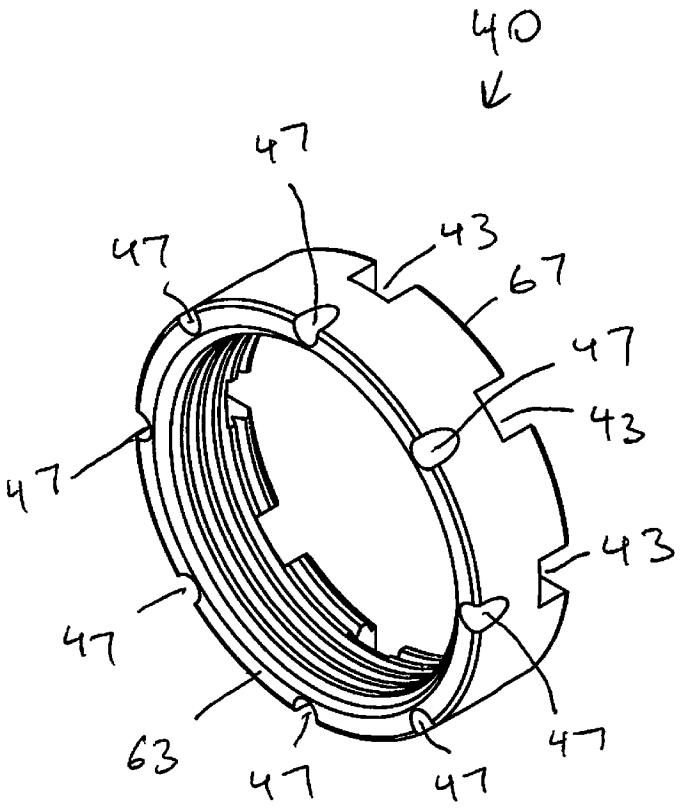
FIG. 4*a* depicts a front, perspective view of castle nut according to some embodiments presently disclosed.
Figure 4B:
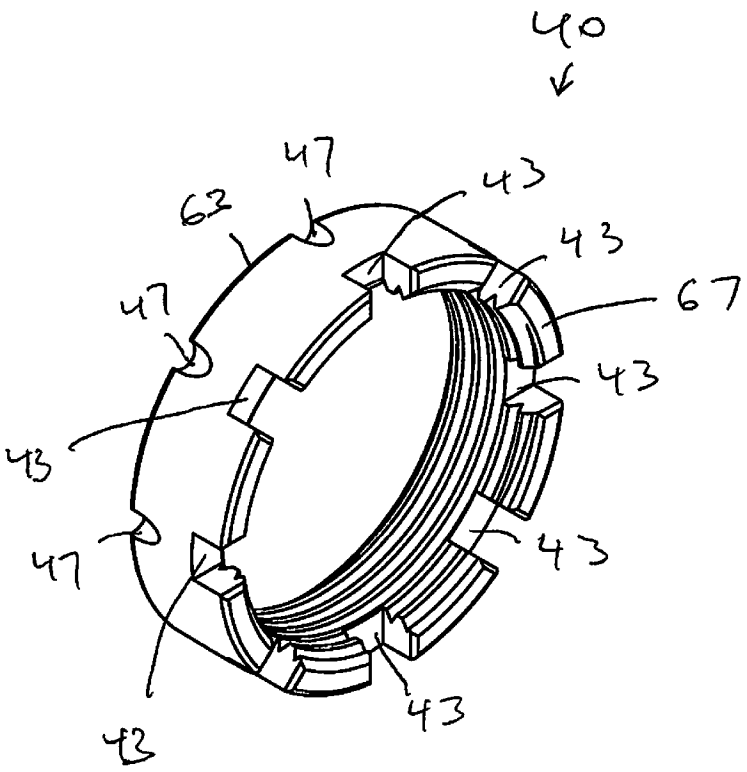
FIG. 4*b* depicts a rear, perspective view of castle nut according to some embodiments presently disclosed.

According to some embodiments presently disclosed, the castle nut 40 comprises a forward end 63 and a rear end 67 (shown in FIGS. 4*a-b*). According to some embodiments presently disclosed, the forward end 63 of the castle nut 40 comprises a first plurality of apertures 47. According to some embodiments presently disclosed, the rear end 67 of the castle nut 40 comprises a second plurality of apertures 43. According to some embodiments presently disclosed, the first plurality of apertures 47 is positioned directly across from the second plurality of apertures 43. According to some embodiments presently disclosed, one or more apertures 47 are positioned directly across from one or more apertures 43. According to some embodiments presently disclosed, the first plurality of apertures 47 is not positioned directly across from the second plurality of apertures 43. According to some embodiments presently disclosed, one or more apertures 47 are not positioned directly across from one or more apertures 43.

Referring to FIGS. 3*a-d*, a staking fixture 50 is shown according to some embodiments presently disclosed. The staking fixture 50 comprises a front surface 51 and a rear surface 53.

The staking fixture 50 further comprises an opening 55 configured to accommodate at least a portion of the circumference of the castle nut 40. According to some embodiments presently disclosed, the opening 55 is semicircular. According to some embodiments presently disclosed, the staking fixture 50 defines the opening 55. According to some embodiments presently disclosed, the staking fixture 50 forms the opening 55.

Figure 3A:
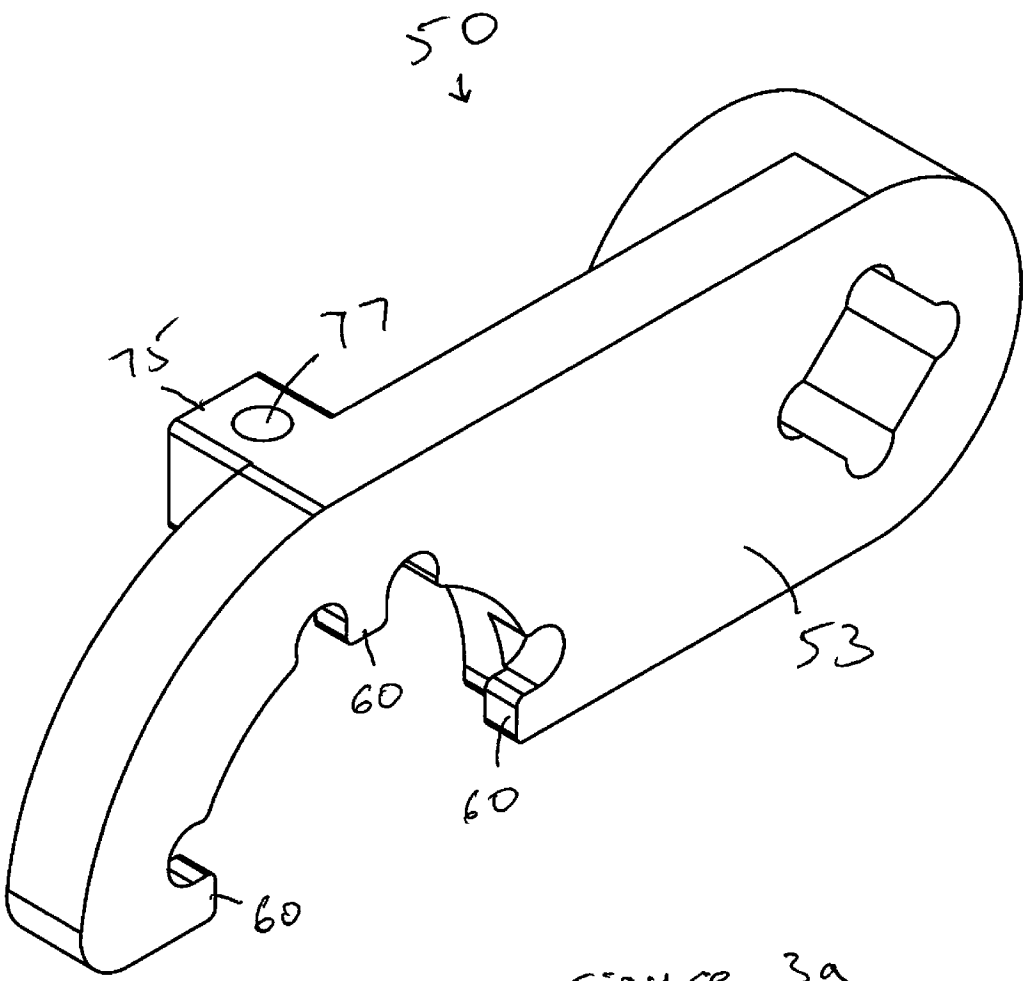
FIG. 3*a* depicts a rear, perspective view of a stacking fixture according to some embodiments presently disclosed.
Figure 3B:
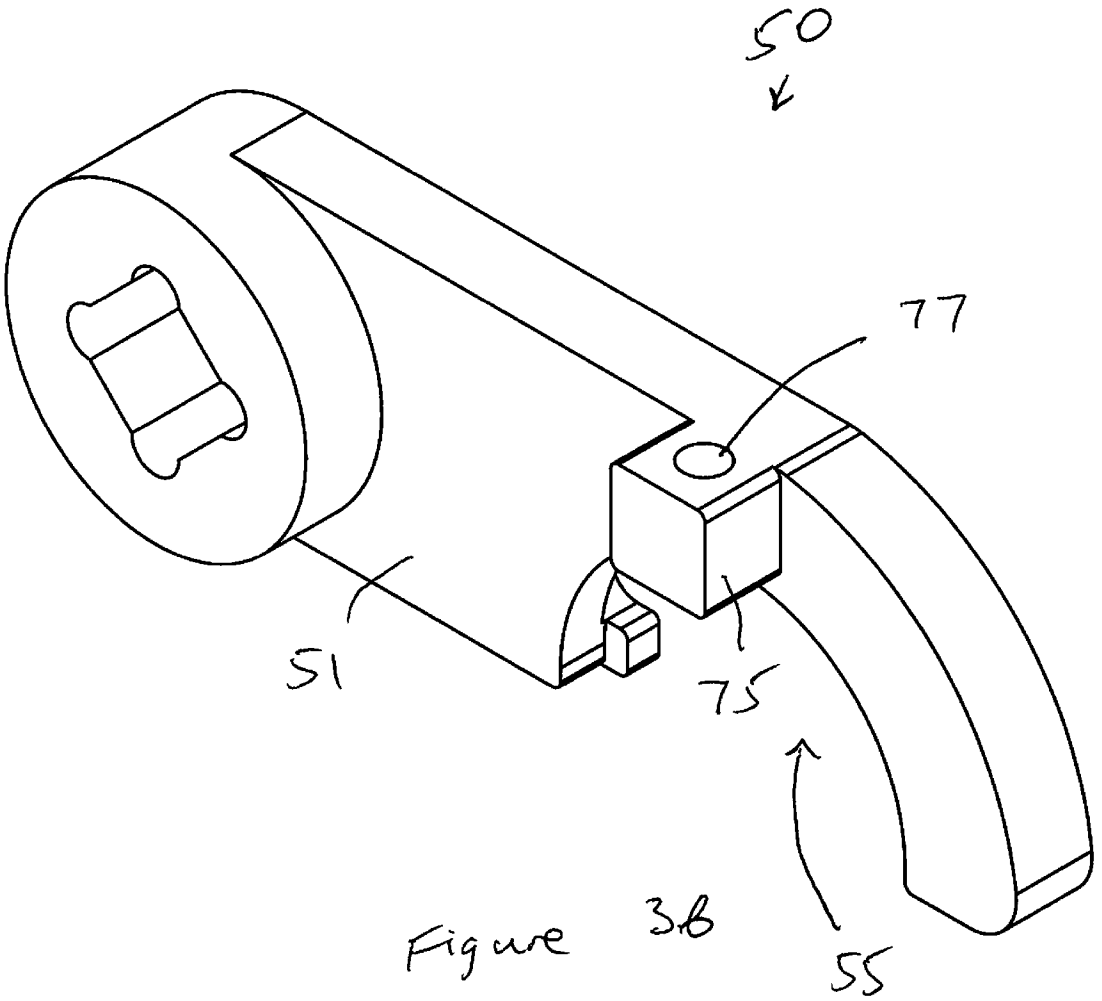
FIG. 3*b* depicts a front, perspective view of the stacking fixture according to some embodiments presently disclosed.
Figure 3C:
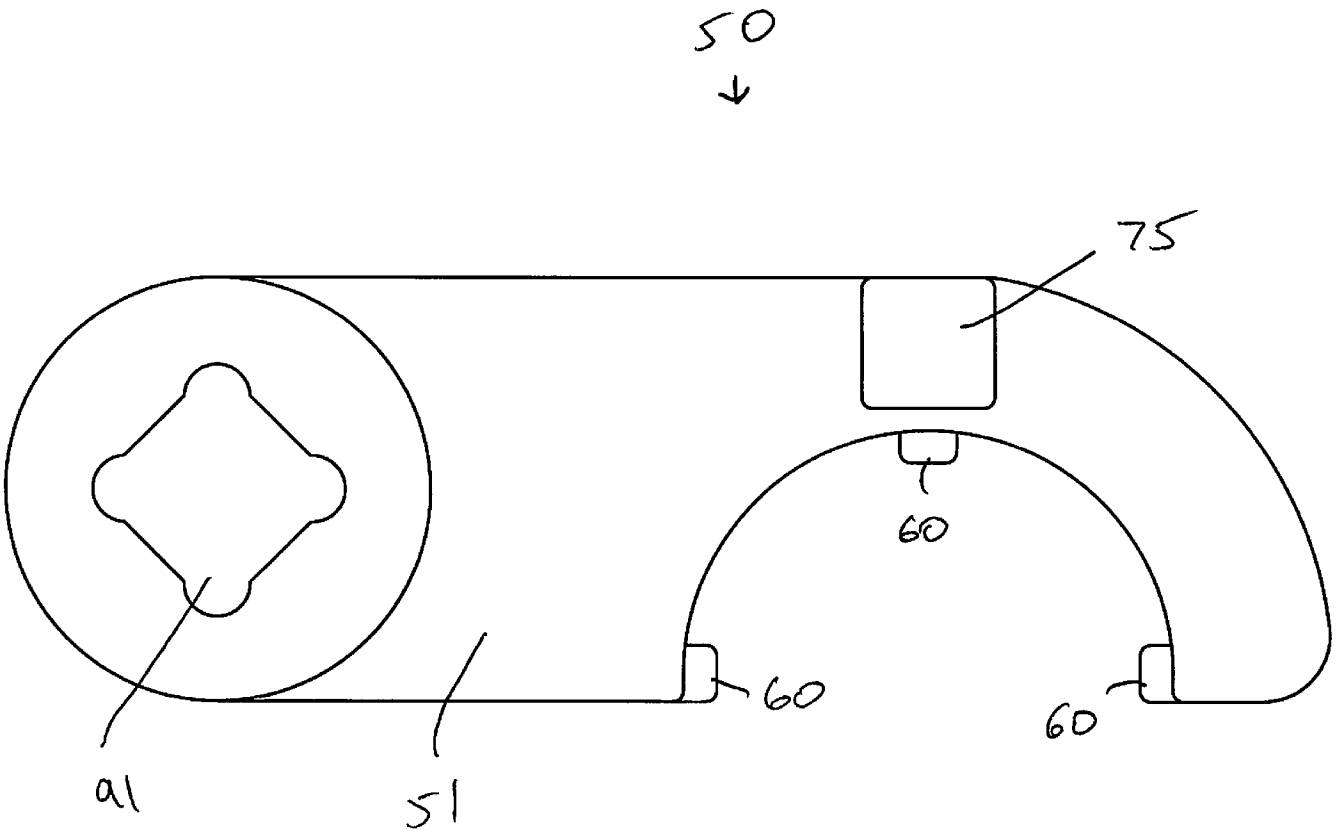
FIG. 3*c* depicts a front view of the stacking fixture according to some embodiments presently disclosed.
Figure 3D:
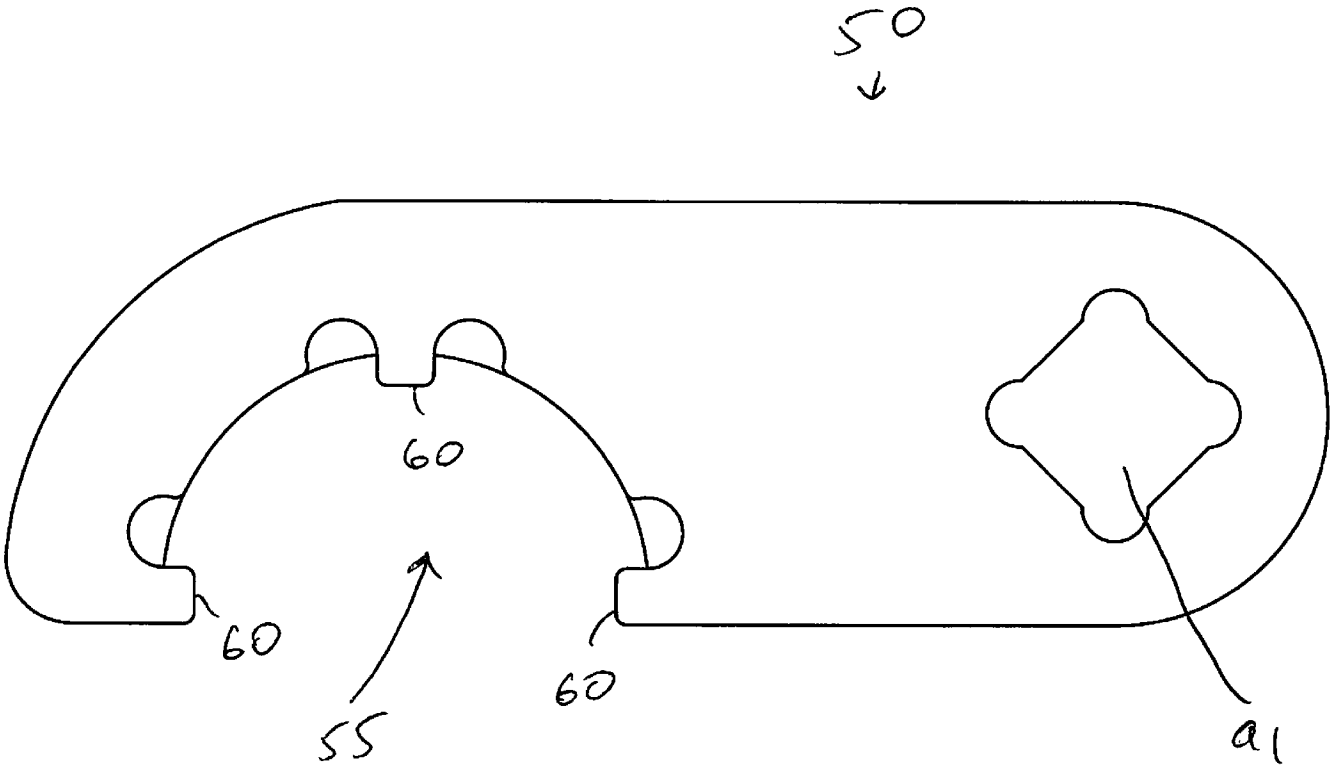
FIG. 3*d* depicts a rear view of the stacking fixture according to some embodiments presently disclosed.

According to some embodiments presently disclosed, the staking fixture 50 comprises one or more protrusions 60 extending into the opening 55 (shown in FIGS. 3*a*, 3*c* and 3*d*). According to some embodiments presently disclosed, the second plurality of apertures 43 of the castle nut 40 are configured to accommodate the one or more protrusions 60 of the staking fixture 50. According to some embodiments presently disclosed, the one or more protrusions 60 of the staking fixture 50 lineup with the second plurality of apertures 43 of the castle nut 40.

According to some embodiments presently disclosed, the staking fixture 50 comprises a forward protrusion 75 extending away from the front surface 51 of the staking fixture 50. The forward protrusion 75 comprises an aperture 77 configured to accommodate a staking punch 79 or 199.

Figure 5:
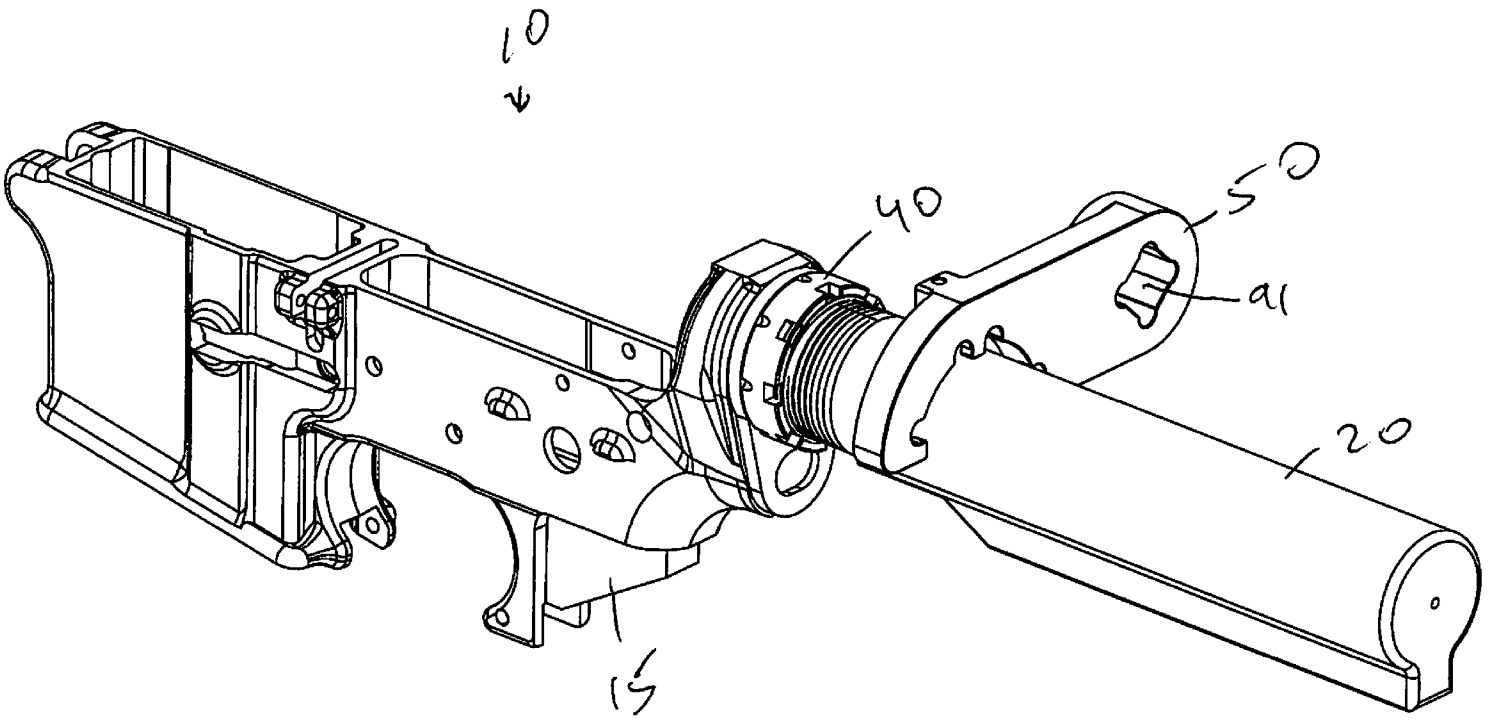
FIG. 5 depicts a rear, perspective view of the firearm according to some embodiments presently disclosed.
Figure 6:
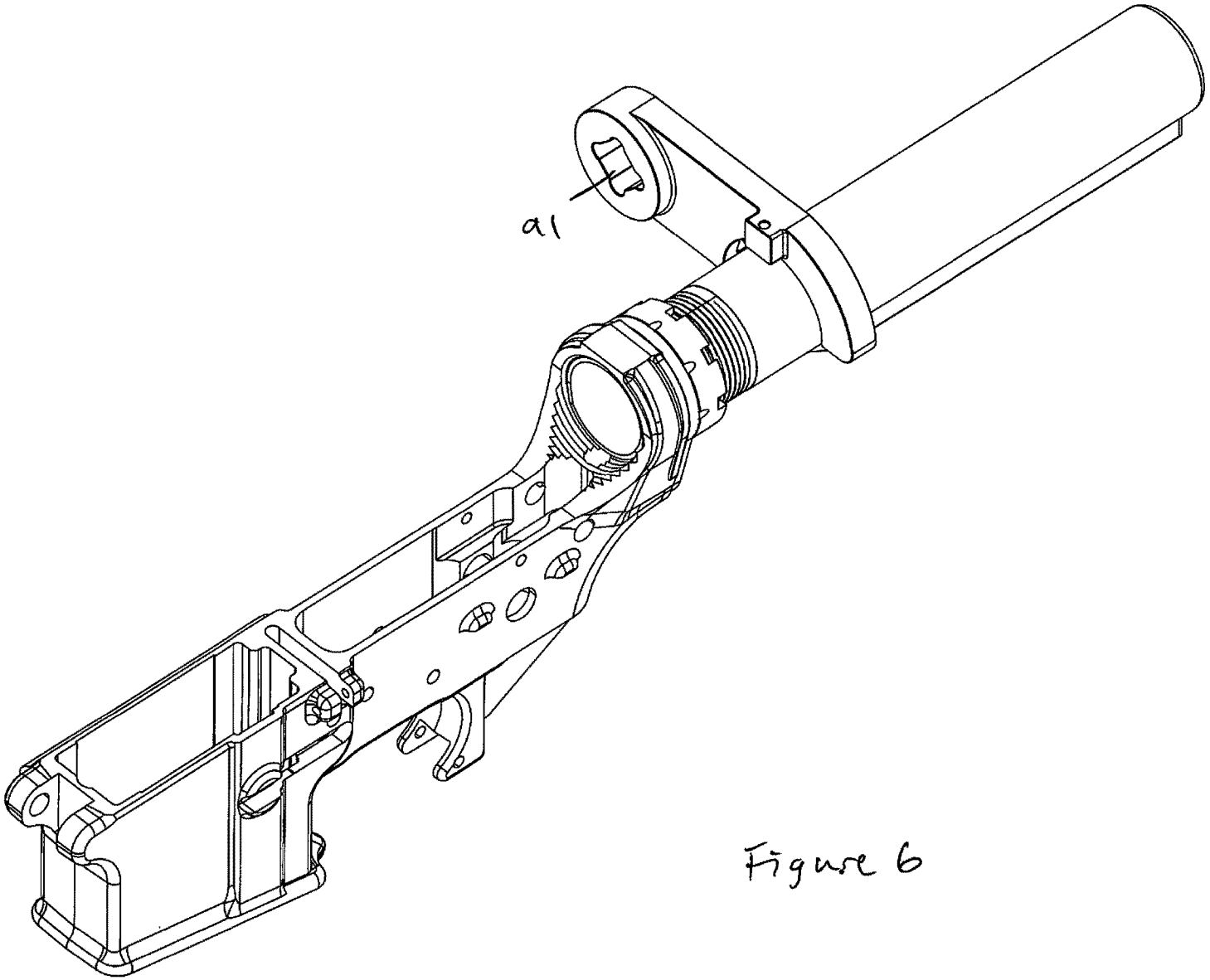
FIG. 6 depicts a front, perspective view of the firearm according to some embodiments presently disclosed.
Figure 7:
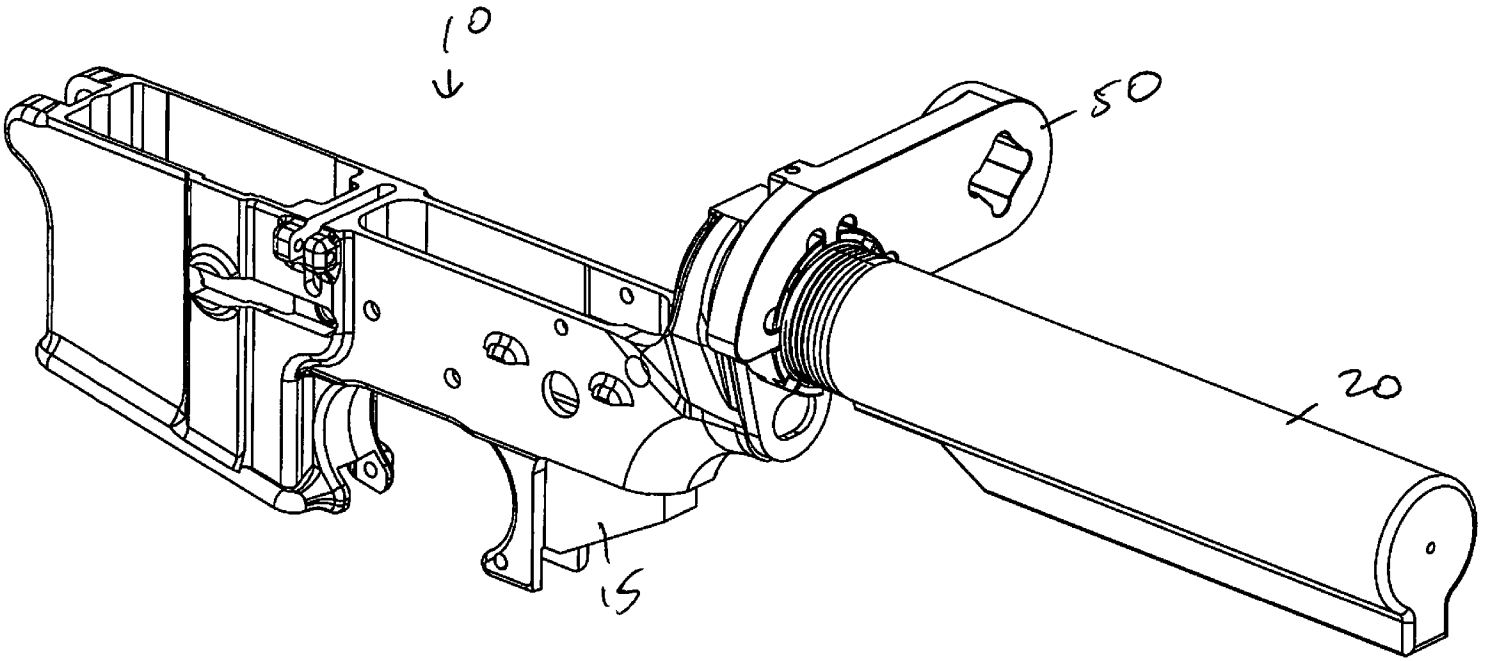
FIG. 7 depicts another rear, perspective view of the firearm according to some embodiments presently disclosed.
Figure 8:
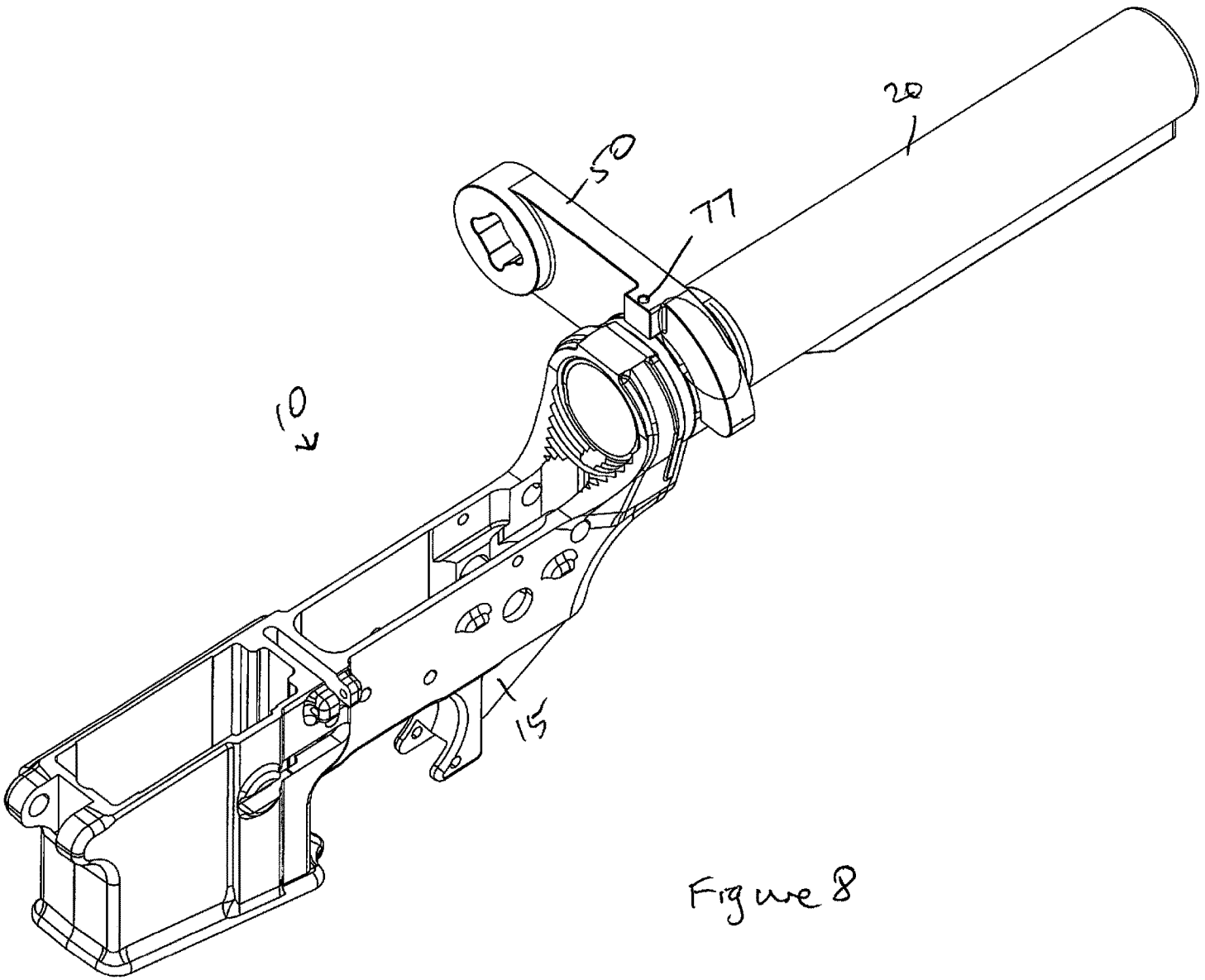
FIG. 8 depicts another front, perspective view of the firearm according to some embodiments presently disclosed.

According to some embodiments presently disclosed, the staking fixture 50 is pushed along the buffer tube 20 (shown in FIGS. 5-6) until the protrusions 60 are positioned within the apertures 43 of the castle nut 40 (shown in FIGS. 7-8). According to some embodiments presently disclosed, the aperture 77 of the forward protrusion 75 is positioned above at least a portion of the end plate 35 when the protrusions 60 are positioned within the apertures 43 of the castle nut 40 (shown in FIG. 8).

Figure 9:
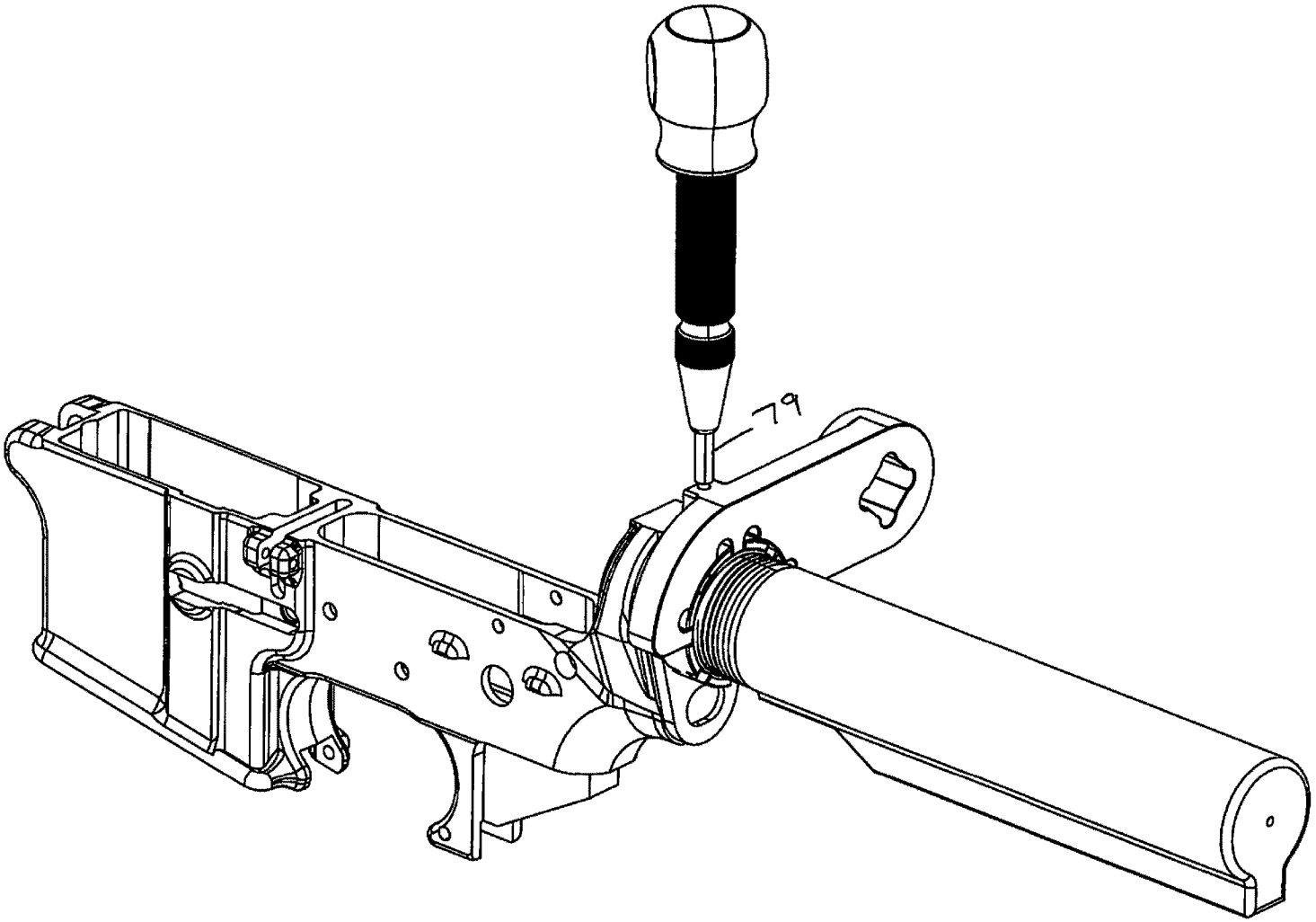
FIG. 9 depicts another rear, perspective view of the firearm according to some embodiments presently disclosed.
Figure 10:
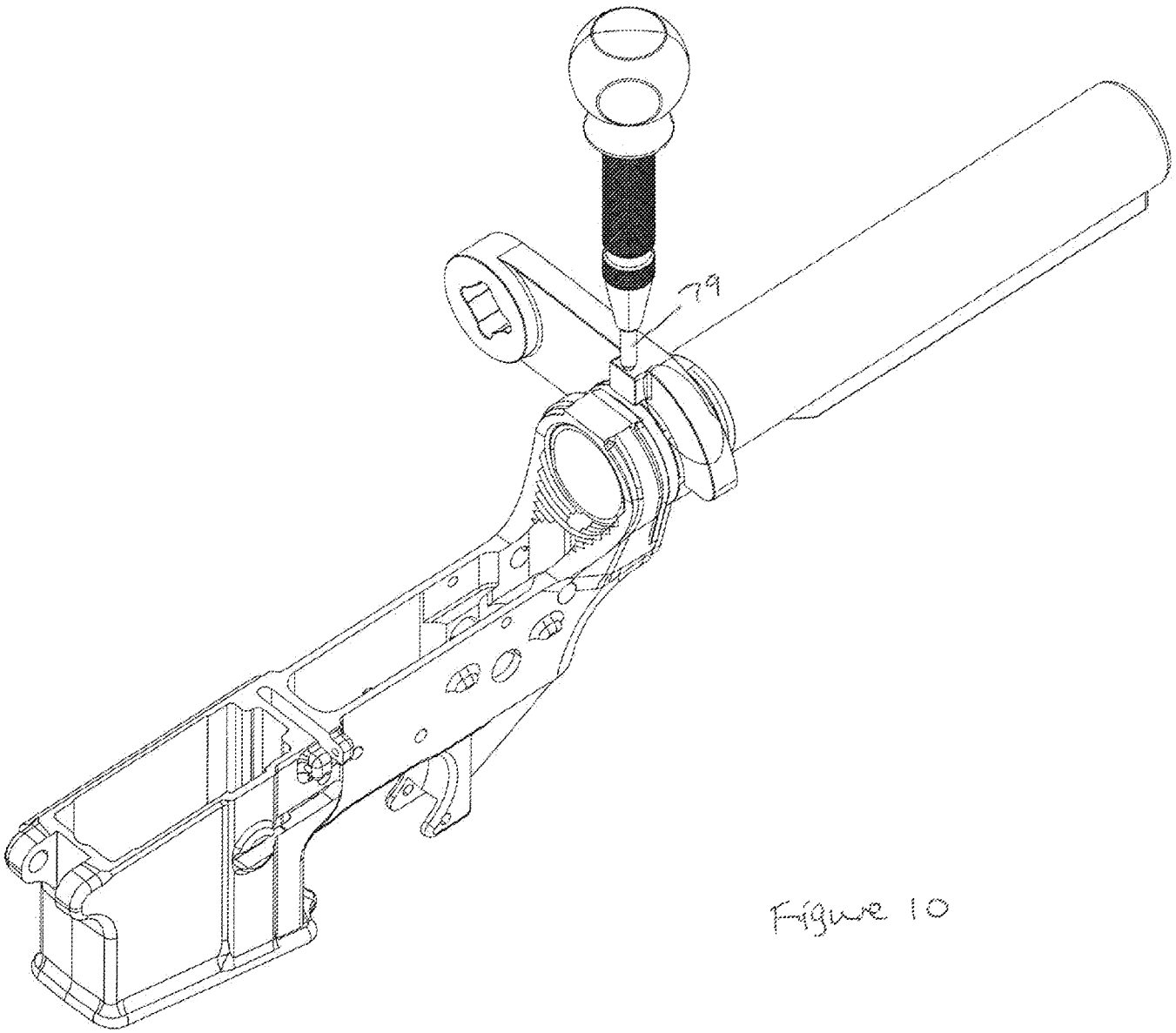
FIG. 10 depicts another front, perspective view of the firearm according to some embodiments presently disclosed.
Figure 11:
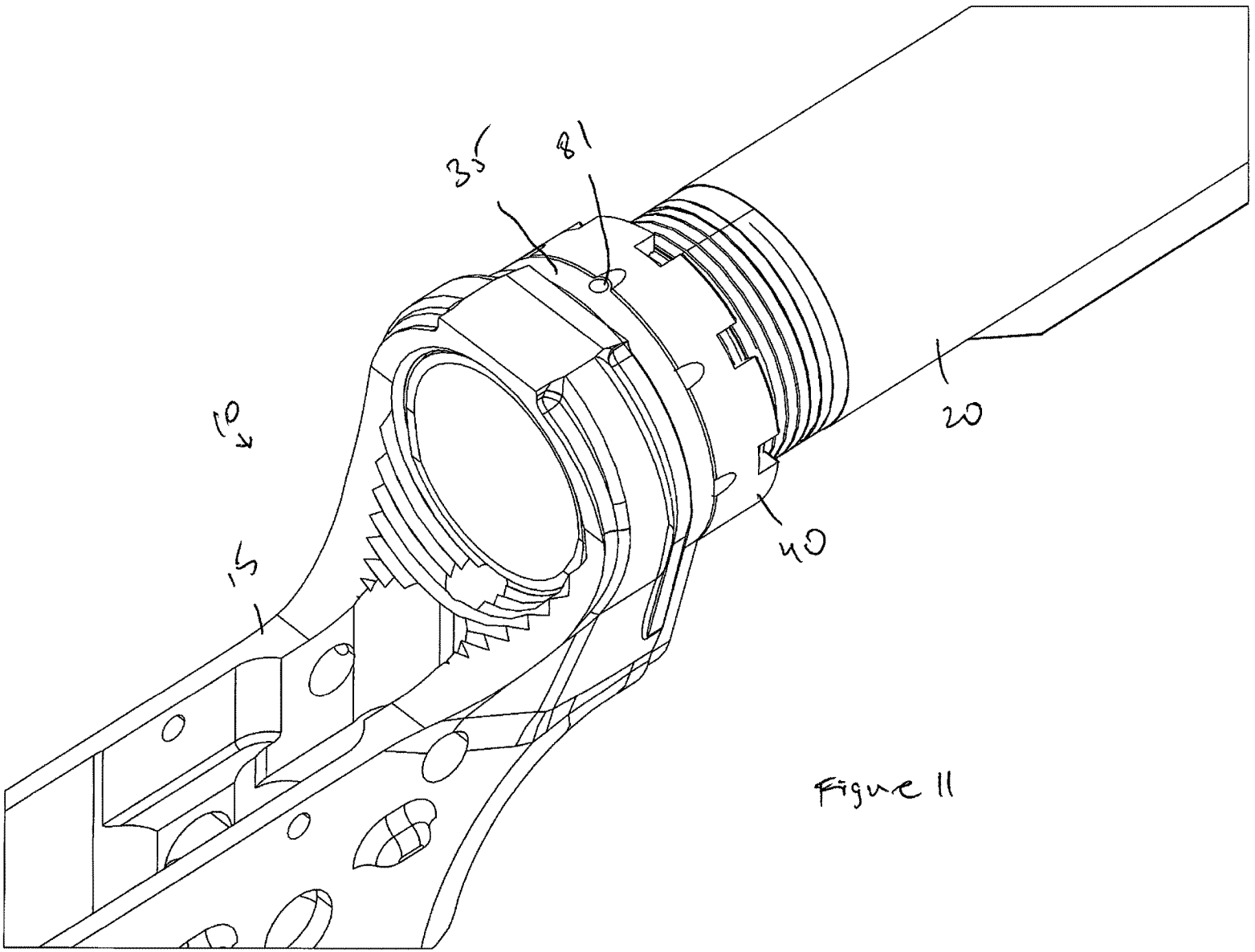
FIG. 11 depicts another front, perspective view of the firearm according to some embodiments presently disclosed.
Figure 12:
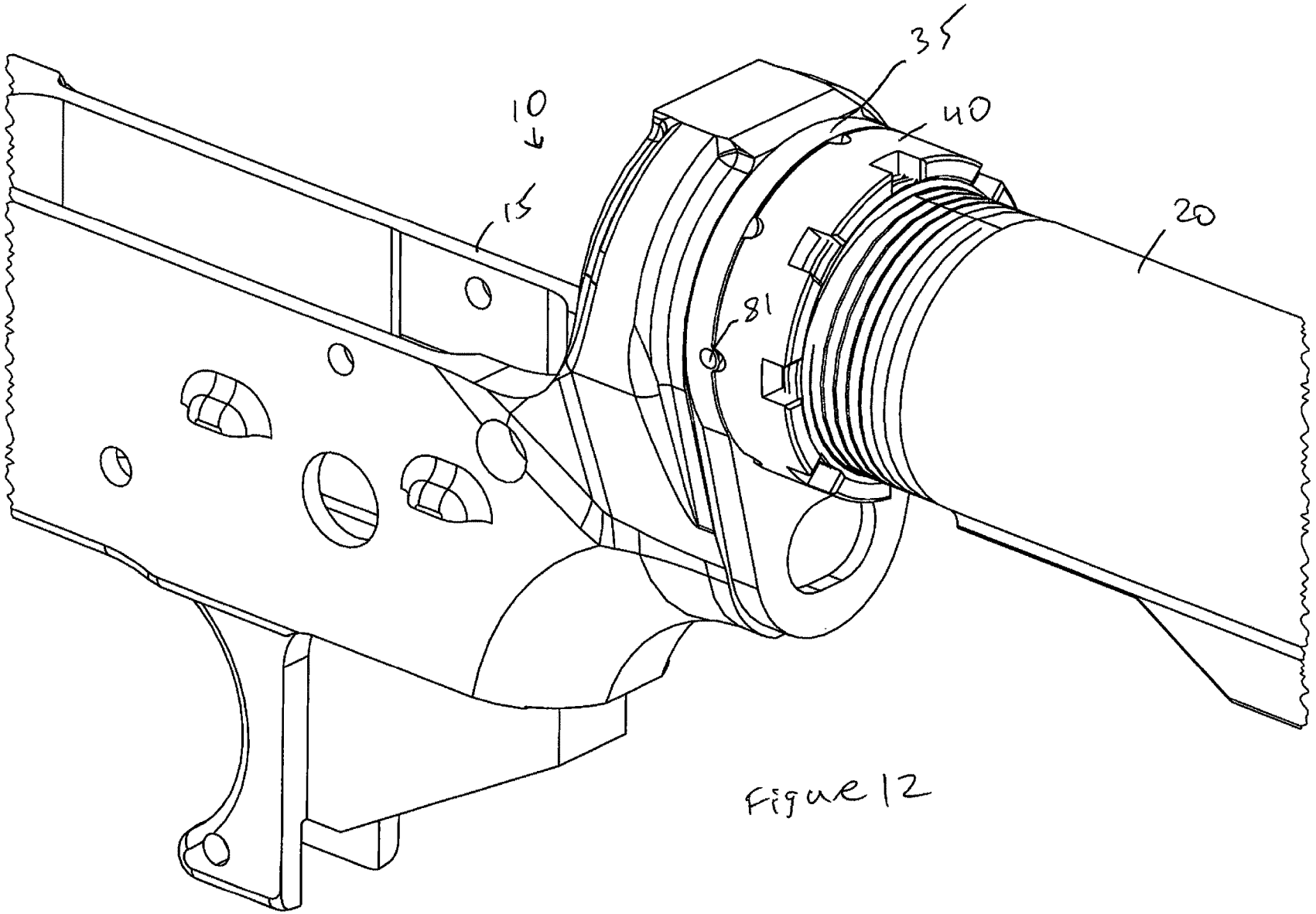
FIG. 12 depicts another rear, perspective view of the firearm according to some embodiments presently disclosed.
Figure 13:
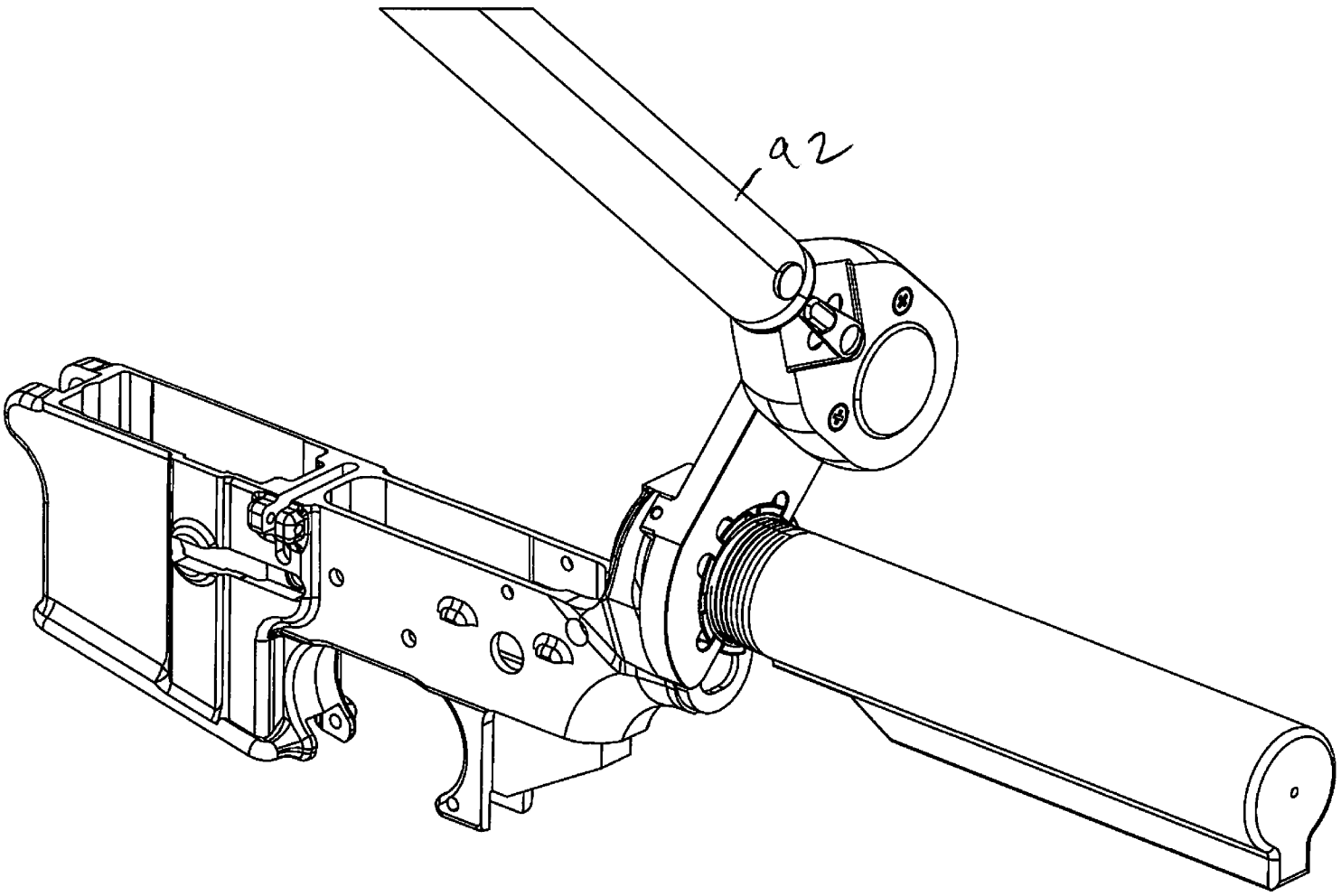
FIG. 13 depicts another rear, perspective view of the firearm according to some embodiments presently disclosed.

Placing a staking punch 79 into the aperture 77 (shown in FIGS. 9-10) positions the staking punch 79 above at least a portion of the end plate 35. Applying a striking force (for example, with a hammer), to the staking punch 79, deforms a portion 81 of the end plate 35, causing a portion of the end plate 35 to move into at least one of the apertures 47 (shown in FIGS. 11-12). According to some embodiments presently disclosed, the portion of the end plate 35 that is positioned in the aperture 47 prevents the castle nut from rotating away from the end plate 35. According to some embodiments presently disclosed, the staking fixture 50 may be repositioned, allowing a user to cause multiple deformations portions 81 along the end plate 35.

According to some embodiments presently disclosed, the staking fixture 50 comprises a tool aperture 91 to receive a tool 92. According to some embodiments presently disclosed, the tool 92 may be used to tighten the castle nut 40 against the end plate 35 prior to forming deformation portions 81.

Figure 14:
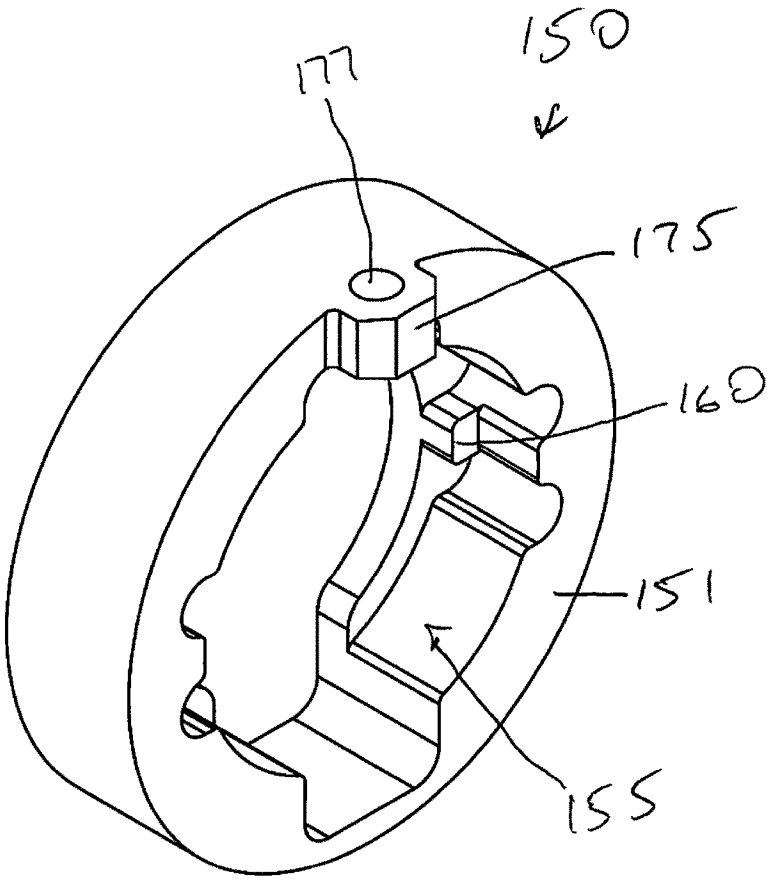
FIG. 14 depicts a front, perspective view of another stacking fixture according to some embodiments presently disclosed.
Figure 15:
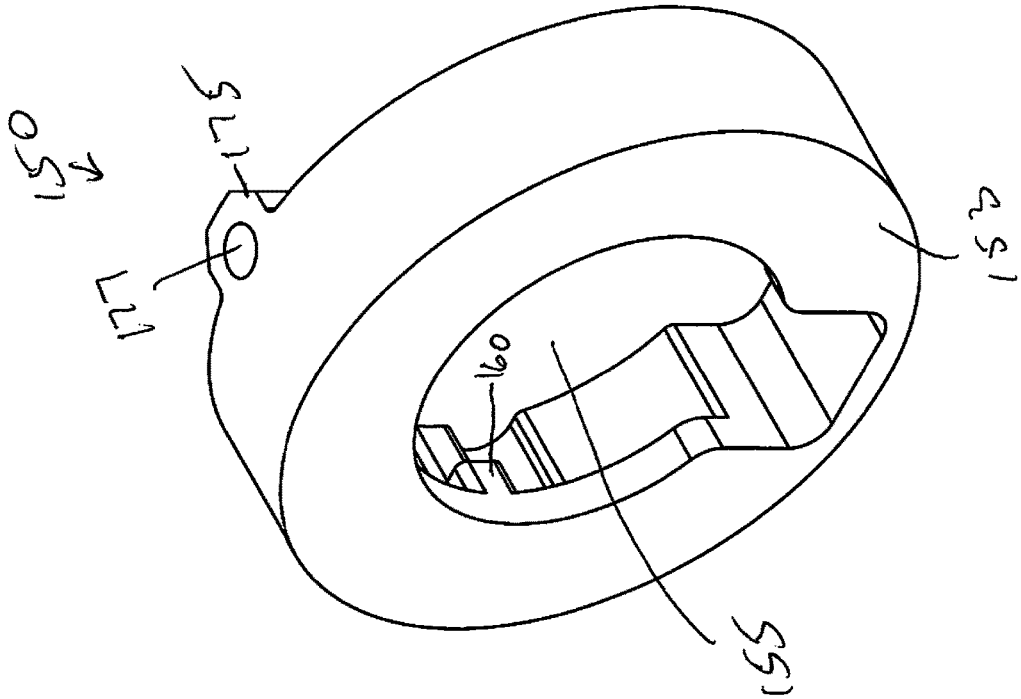
FIG. 15 depicts a rear, perspective view of the another stacking fixture according to some embodiments presently disclosed.

Referring to FIGS. 14-15, another staking fixture 150 is shown according to some embodiments presently disclosed. The staking fixture 150 comprises a front surface 151 and a rear surface 153.

The staking fixture 150 further comprises an opening 155 configured to accommodate at the circumference of the castle nut 40. According to some embodiments presently disclosed, the opening 155 is circular. According to some embodiments presently disclosed, the staking fixture 150 defines the opening 155. According to some embodiments presently disclosed, the staking fixture 150 forms the opening 155.

According to some embodiments presently disclosed, the staking fixture 150 comprises a plurality of protrusions 160 extending into the opening 155 (shown in FIGS. 14-15). According to some embodiments presently disclosed, the second plurality of apertures 43 of the castle nut 40 are configured to accommodate the protrusions 160 of the staking fixture 150. According to some embodiments presently disclosed, the protrusions 160 of the staking fixture 150 lineup with the second plurality of apertures 143 of the castle nut 40.

Figure 19:
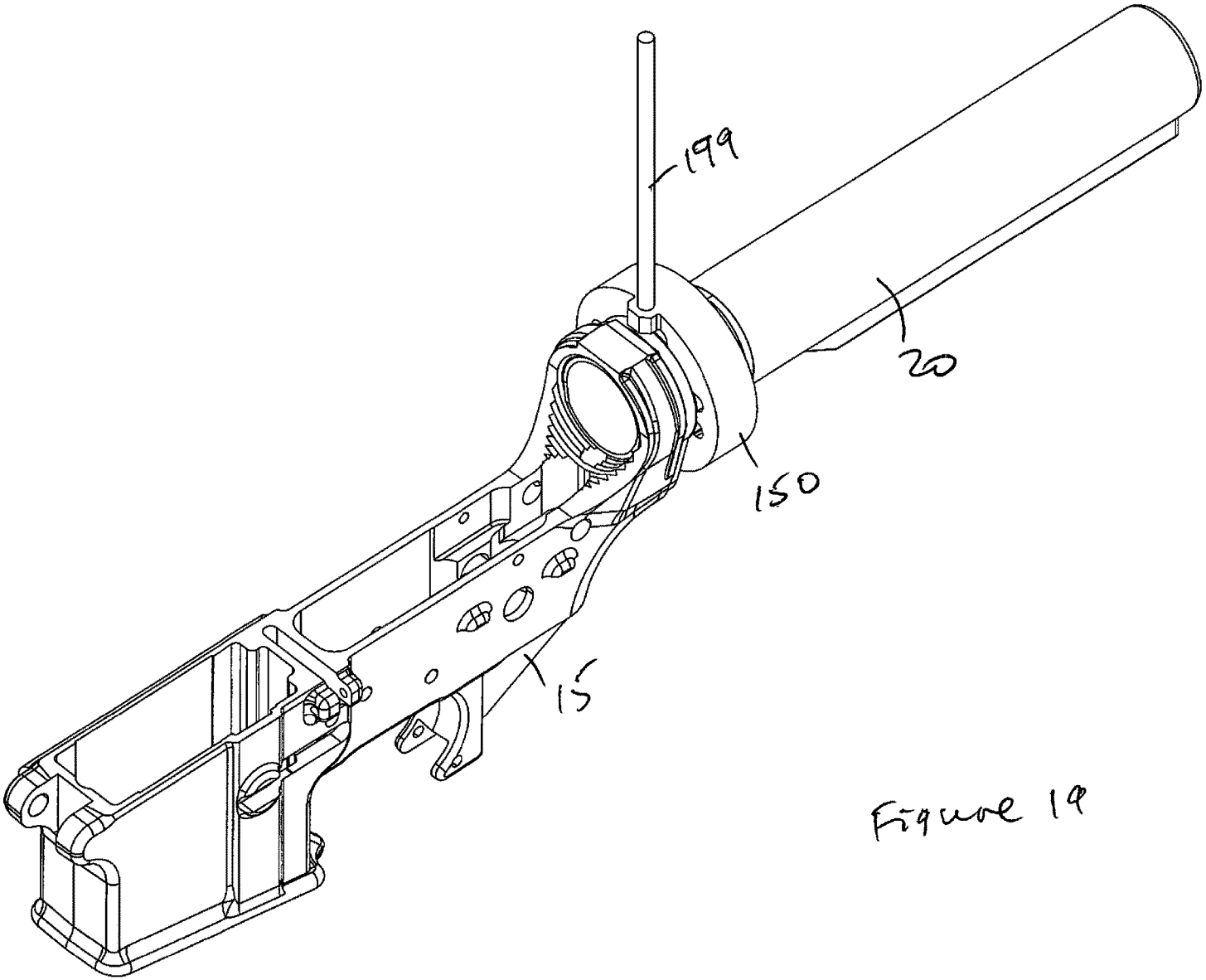
FIG. 19 depicts another front, perspective view of the firearm according to some embodiments presently disclosed.

According to some embodiments presently disclosed, the staking fixture 150 comprises a forward protrusion 175 extending away from the front surface 151 of the staking fixture 150. The forward protrusion 175 comprises an aperture 177 configured to accommodate a staking punch 79 or 199 (shown in FIG. 19).

Figure 16:
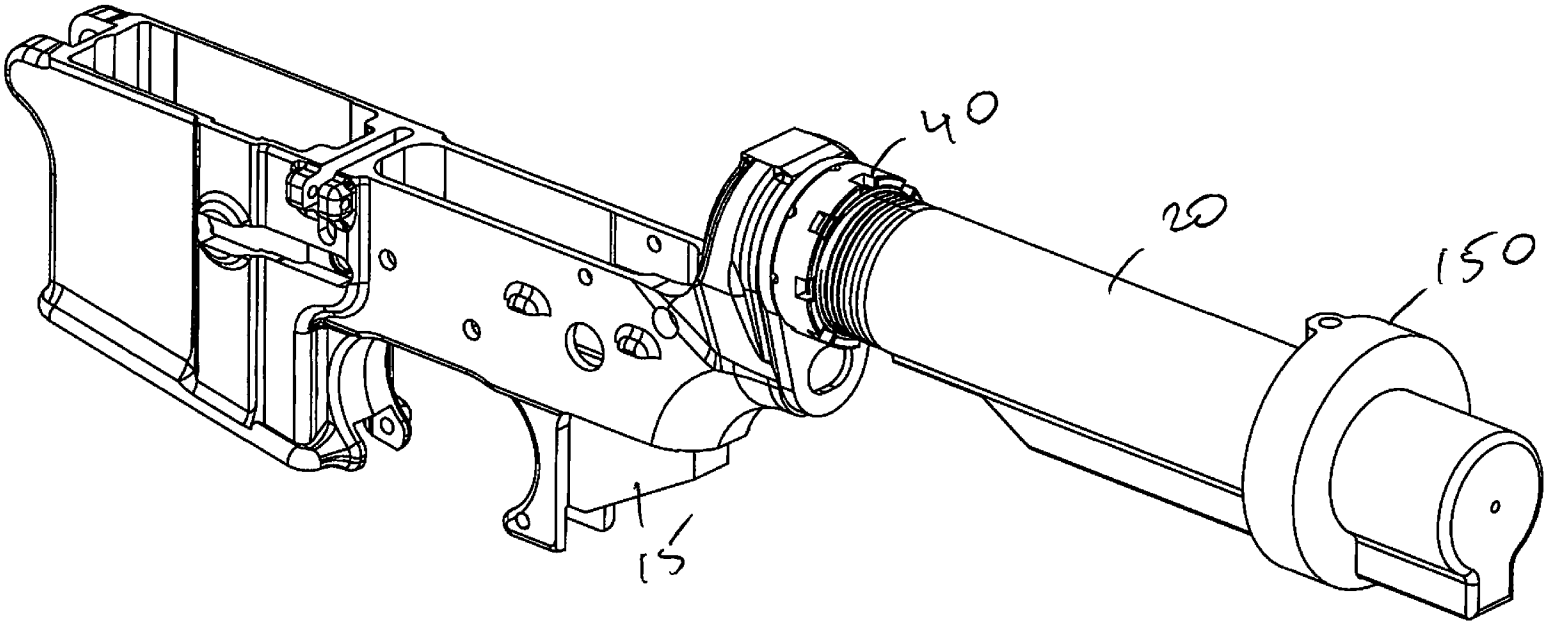
FIG. 16 depicts a rear, perspective view of the firearm according to some embodiments presently disclosed.
Figure 17:
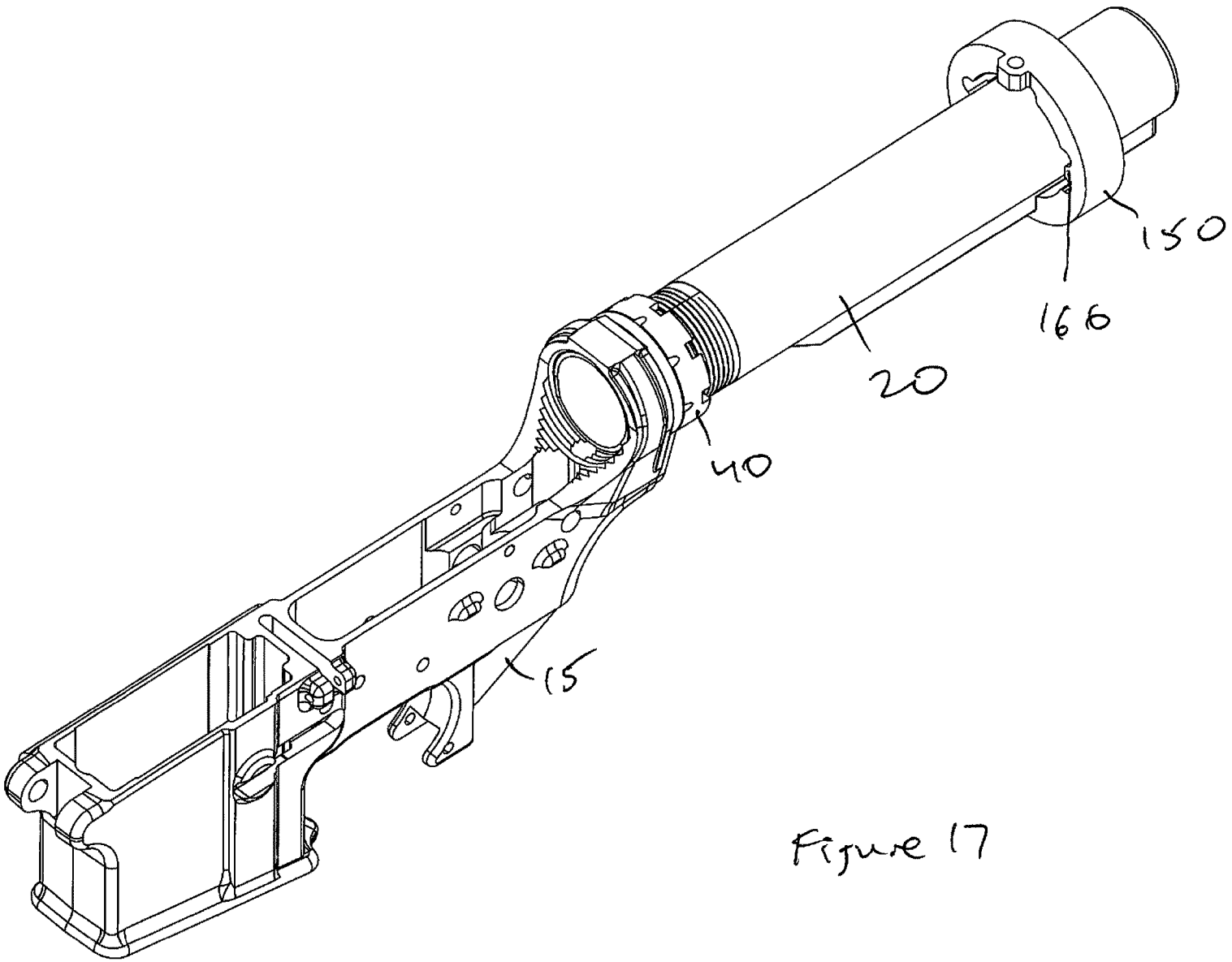
FIG. 17 depicts a front, perspective view of the firearm according to some embodiments presently disclosed.
Figure 18:
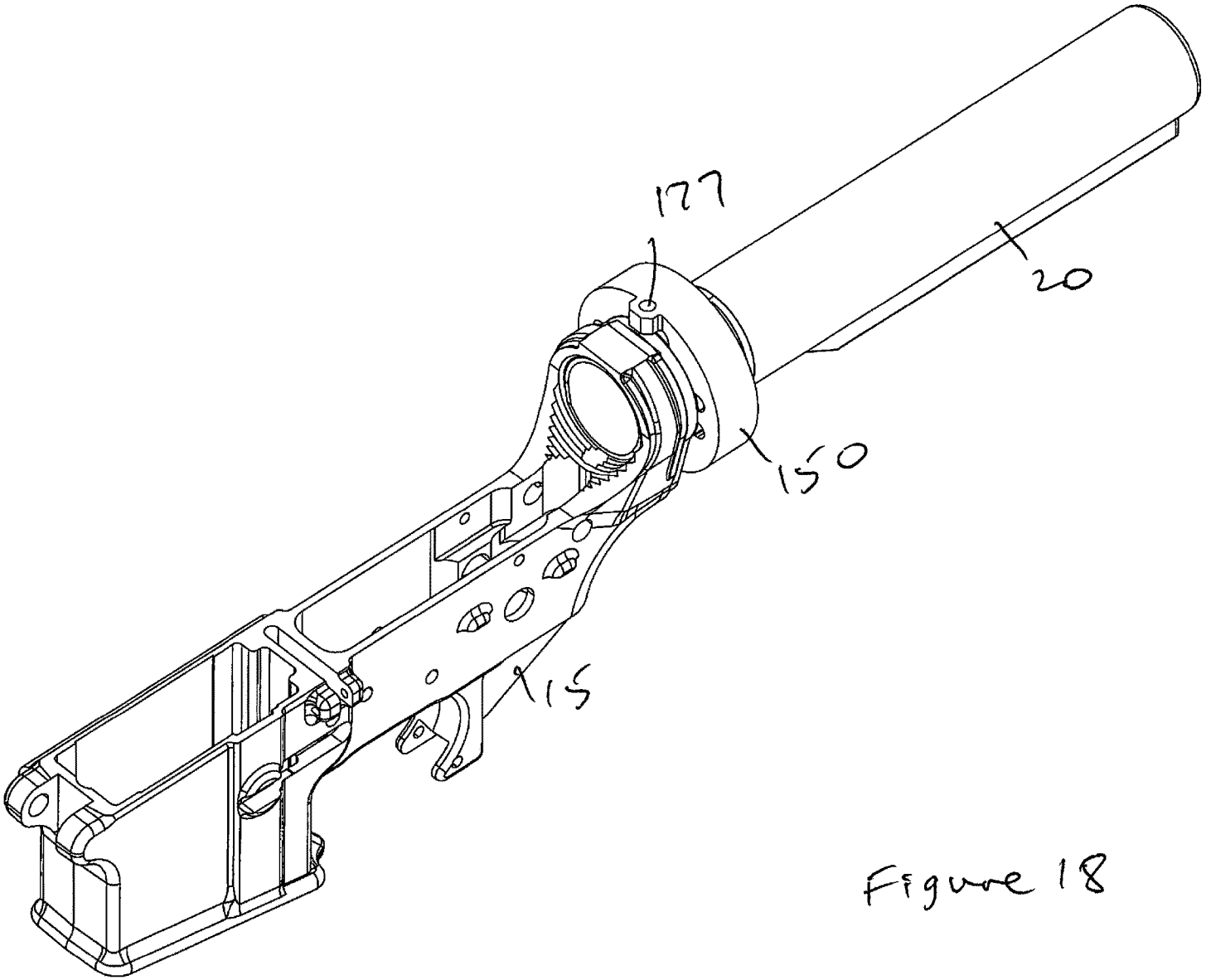
FIG. 18 depicts another front, perspective view of the firearm according to some embodiments presently disclosed.

According to some embodiments presently disclosed, the staking fixture 150 is pushed along the buffer tube 120 (shown in FIGS. 16-17) until the protrusions 160 are positioned within the apertures 43 of the castle nut 40 (shown in FIG. 18). According to some embodiments presently disclosed, the aperture 177 of the forward protrusion 175 is positioned above at least a portion of the end plate 35 when the protrusions 160 are positioned within the apertures 43 of the castle nut 40 (shown in FIG. 18).

Placing a staking punch 79 or 199 (shown in FIG. 19) into the aperture 177 (shown in FIG. 19) positions the staking punch 199 above at least a portion of the end plate 35. Applying a striking force (for example, with a hammer), to the staking punch 199, deforms a portion 81 of the end plate 35, causing a portion of the end plate 35 to move into at least one of the apertures 47 (shown in FIGS. 11-12). According to some embodiments presently disclosed, the portion of the end plate 35 that is positioned in the aperture 47 prevents the castle nut from rotating away from the end plate 35. According to some embodiments presently disclosed, the staking fixture 150 may be repositioned, allowing the user to cause multiple deformations portions 81 along the end plate 35.

Referring to FIGS. 20-24, a staking fixture 250 is shown according to some embodiments presently disclosed. The staking fixture 250 comprises a front surface 251 and a rear surface 253.

The staking fixture 250 further comprises an opening 255 configured to accommodate at least a portion of the circumference of the castle nut 40. According to some embodiments presently disclosed, the opening 255 is semicircular. According to some embodiments presently disclosed, the staking fixture 250 defines the opening 255. According to some embodiments presently disclosed, the staking fixture 250 forms the opening 255.

Figure 24:
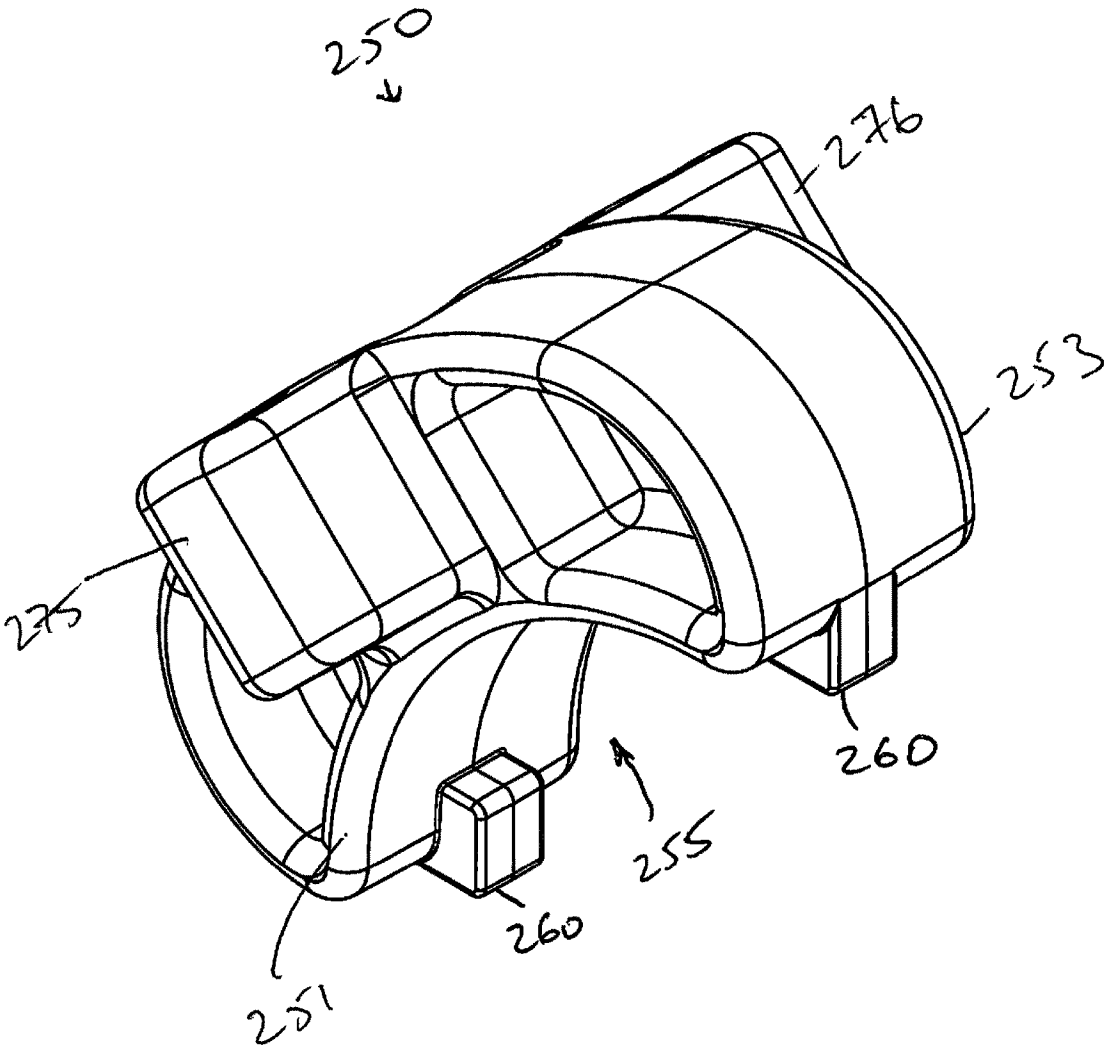
FIG. 24 depicts another perspective view of the stacking fixture according to some embodiments presently disclosed.
Figure 25:
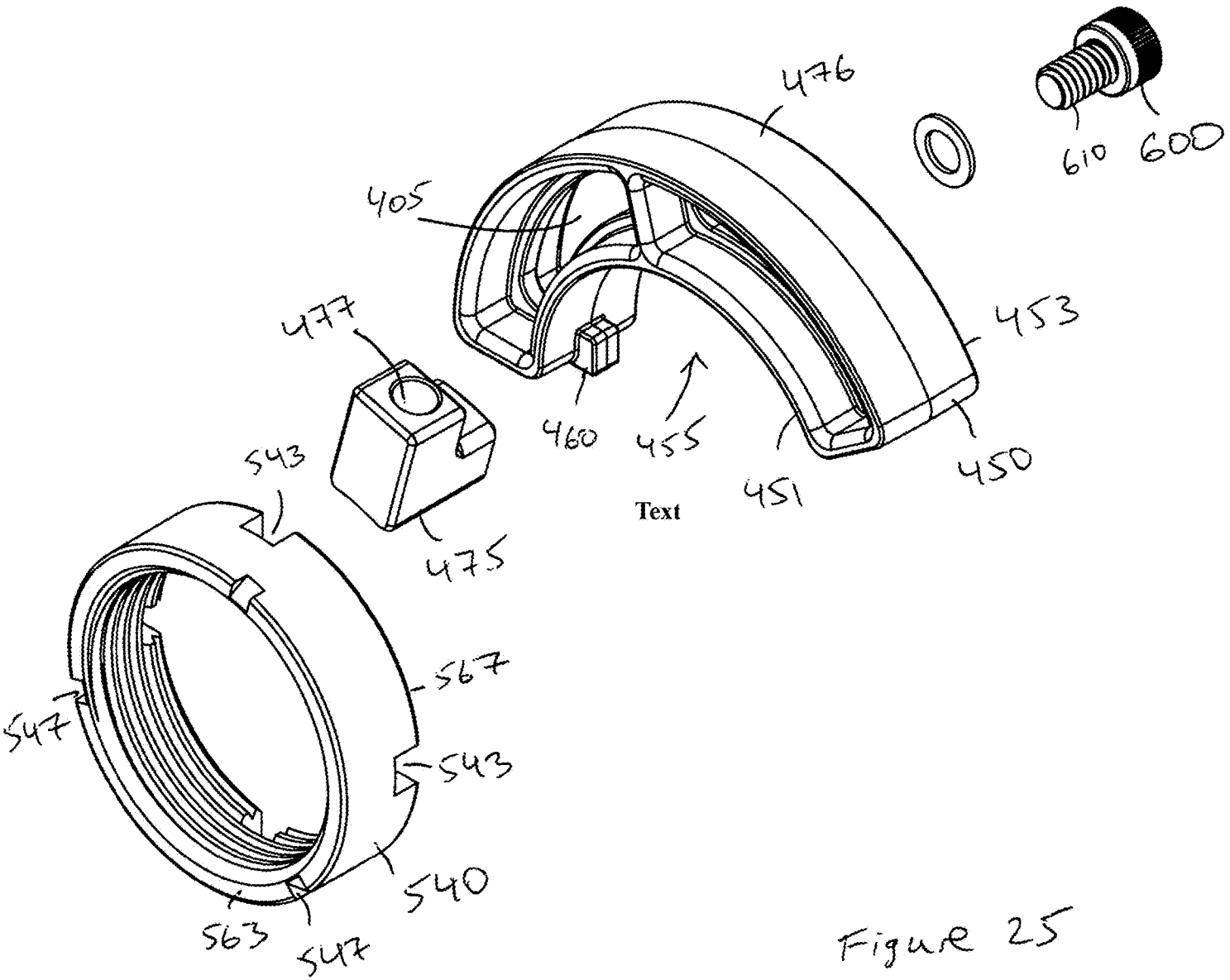
FIG. 25 depicts a perspective view of another stacking fixture according to some embodiments presently disclosed.
Figure 26:
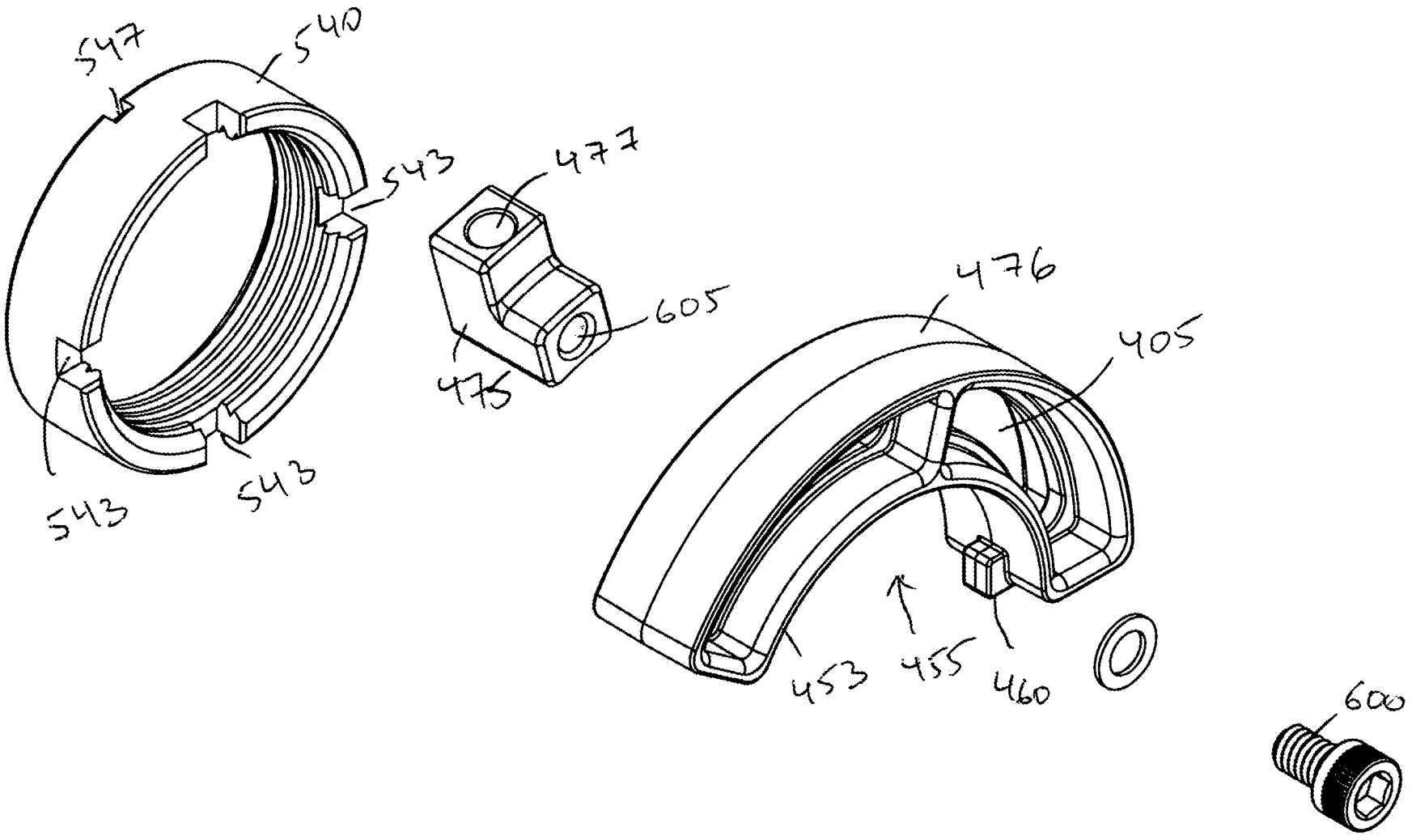
FIG. 26 depicts another perspective view of the stacking fixture according to some embodiments presently disclosed.

According to some embodiments presently disclosed, the staking fixture 250 comprises one or more protrusions 260 extending into the opening 255 (shown in FIG. 24). According to some embodiments presently disclosed, the second plurality of apertures 43 of the castle nut 40 are configured to accommodate the one or more protrusions 260 of the staking fixture 250. According to some embodiments presently disclosed, the one or more protrusions 260 of the staking fixture 250 lineup with the second plurality of apertures 43 of the castle nut 40.

According to some embodiments presently disclosed, the staking fixture 250 comprises a forward protrusion 275 extending away from the front surface 251 of the staking fixture 250. The forward protrusion 275 comprises an aperture 277 configured to accommodate the staking punch 79 or 199. According to some embodiments presently disclosed, the staking fixture 250 comprises a rearward protrusion 276 extending away from the rear surface 253 of the staking fixture 250. The rearward protrusion 276 comprises an aperture 278 configured to accommodate the staking punch 79 or 199.

According to some embodiments presently disclosed, the staking fixture 250 is pushed along the buffer tube 20 until the one or more protrusions 260 are positioned within the apertures 43 of the castle nut 40. According to some embodiments presently disclosed, the aperture 277 of the forward protrusion 275 is positioned above at least a portion of the end plate 35 when the one or more protrusions 260 are positioned within the apertures 43 of the castle nut 40.

Placing a staking punch 79 or 99 into the aperture 277 positions the staking punch 79 above at least a portion of the end plate 35. Applying a striking force (for example, with a hammer), to the staking punch 79, deforms a portion 81 of the end plate 35, causing a portion of the end plate 35 to move into at least one of the apertures 47 (shown in FIGS. 11-12). According to some embodiments presently disclosed, the portion of the end plate 35 that is positioned in the aperture 47 prevents the castle nut from rotating away from the end plate 35. According to some embodiments presently disclosed, the staking fixture 250 may be repositioned, allowing a user to cause multiple deformations portions 81 along the end plate 35.

Figure 20:
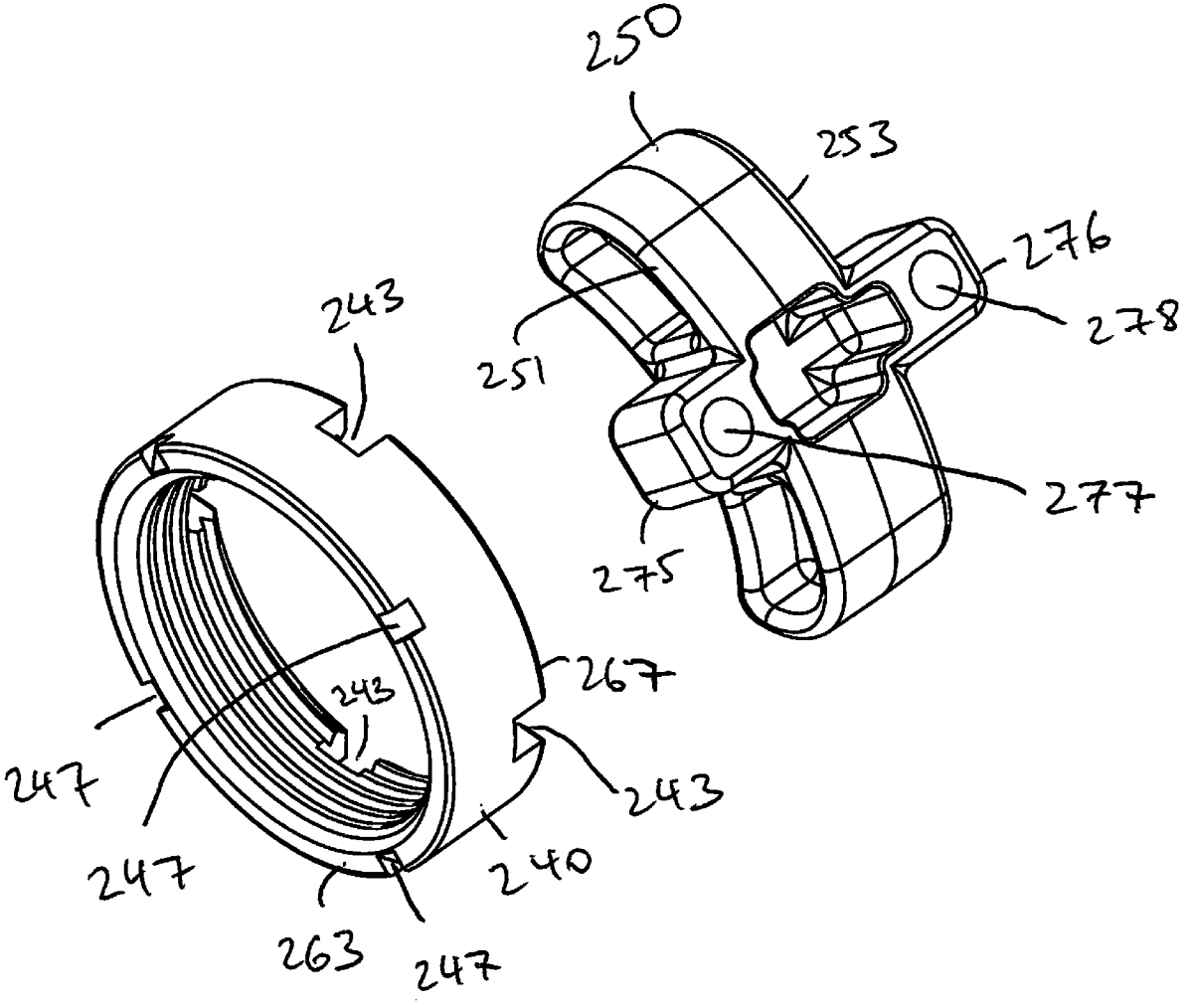
FIG. 20 depicts a perspective view of another stacking fixture according to some embodiments presently disclosed.
Figure 21:
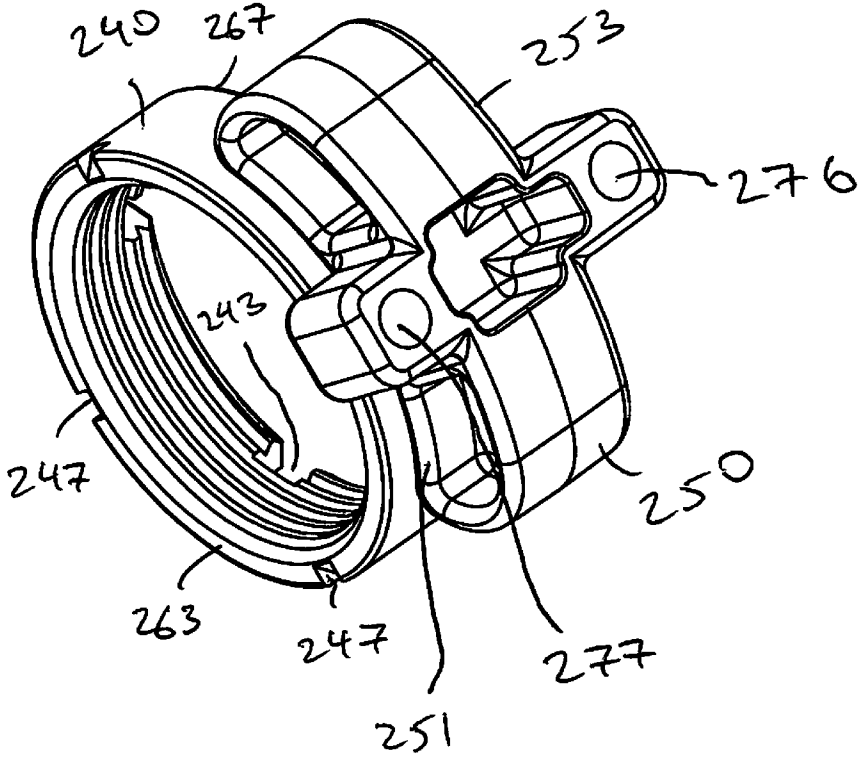
FIG. 21 depicts another perspective view of the stacking fixture according to some embodiments presently disclosed.

According to some embodiments presently disclosed, a castle nut 240 is shown in FIGS. 20-21. The castle nut 240 comprises a forward end 263 and a rear end 267.

According to some embodiments presently disclosed, the forward end 263 of the castle nut 240 comprises a first plurality of apertures 247. According to some embodiments presently disclosed, the rear end 267 of the castle nut 240 comprises a second plurality of apertures 243. According to some embodiments presently disclosed, the first plurality of apertures 247 is positioned directly across from the second plurality of apertures 243. According to some embodiments presently disclosed, one or more apertures 247 are positioned directly across from one or more apertures 243. According to some embodiments presently disclosed, the first plurality of apertures 247 is not positioned directly across from the second plurality of apertures 243. According to some embodiments presently disclosed, one or more apertures 247 are not positioned directly across from one or more apertures 243. According to some embodiments presently disclosed, at least one of the apertures 247 is positioned across from and between two adjacent apertures 243. According to some embodiments presently disclosed, the castle nut 240 comprises a first width from the rear end 267 to the forward end 263. According to some embodiments presently disclosed, the castle nut 240 comprises a first distance from the rear end 267 to the forward end 263.

According to some embodiments presently disclosed, the staking fixture 250 is pushed along the buffer tube 20 until the one or more protrusions 260 are positioned within the apertures 243 of the castle nut 240. According to some embodiments presently disclosed, the aperture 277 of the forward protrusion 275 is positioned above at least a portion of the end plate 35 when the one or more protrusions 260 are positioned within the apertures 243 of the castle nut 240.

Placing a staking punch 79 or 99 into the aperture 277 positions the staking punch 79 or 99 above at least a portion of the end plate 35. Applying a striking force (for example, with a hammer), to the staking punch 79 or 99, deforms a portion 81 of the end plate 35, causing a portion of the end plate 35 to move into at least one of the apertures 247. According to some embodiments presently disclosed, the portion of the end plate 35 that is positioned in the aperture 247 prevents the castle nut from rotating away from the end plate 35. According to some embodiments presently disclosed, the staking fixture 250 may be repositioned, allowing a user to cause multiple deformations portions 81 along the end plate 35.

Figure 22:
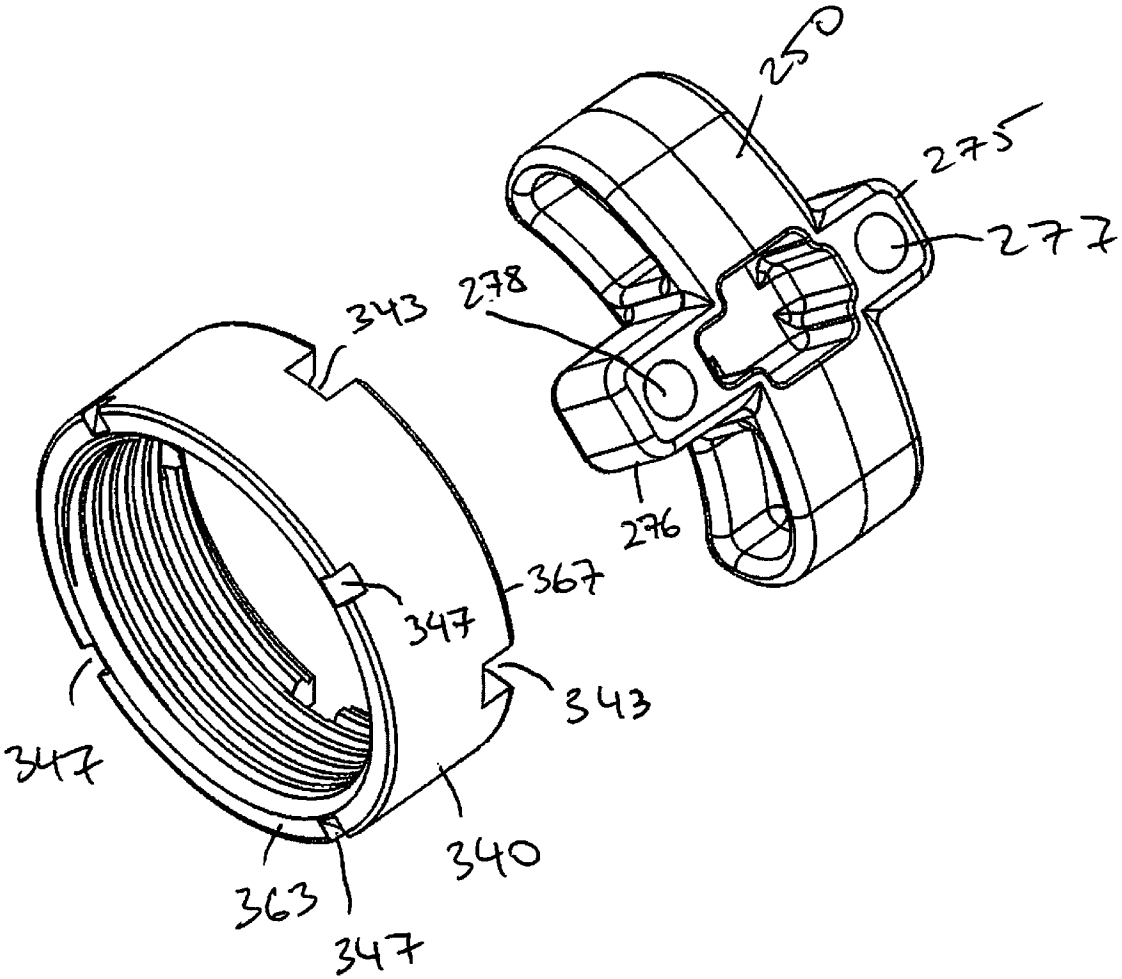
FIG. 22 depicts another perspective view of the stacking fixture according to some embodiments presently disclosed.
Figure 23:
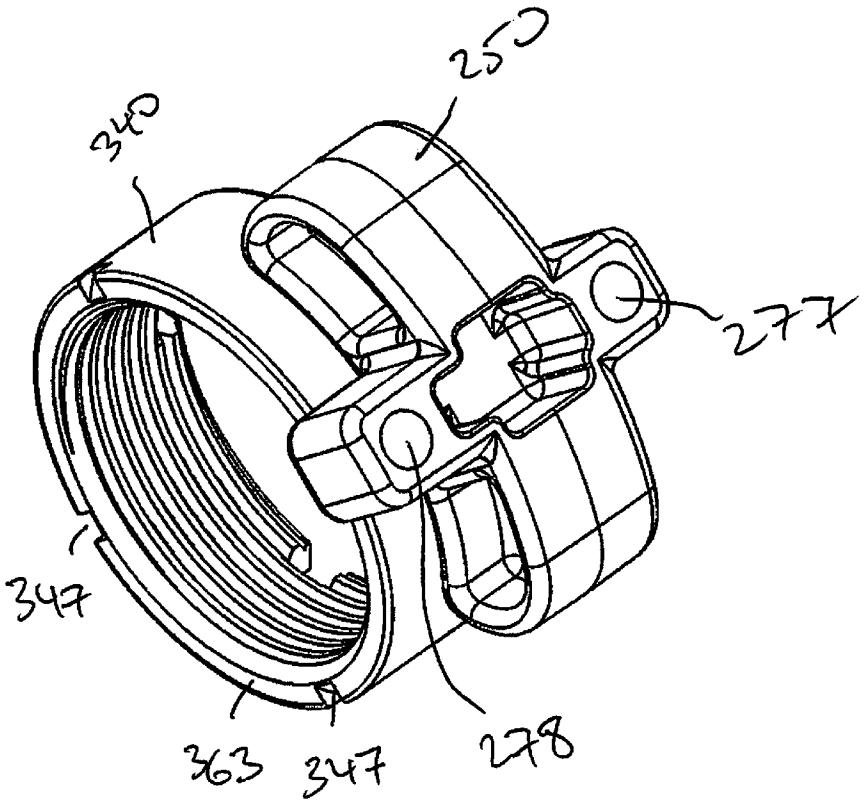
FIG. 23 depicts another perspective view of the stacking fixture according to some embodiments presently disclosed.

According to some embodiments presently disclosed, a castle nut 340 is shown in FIGS. 22-23. The castle nut 340 comprises a forward end 363 and a rear end 367. According to some embodiments presently disclosed, the forward end 363 of the castle nut 340 comprises a first plurality of apertures 347. According to some embodiments presently disclosed, the rear end 367 of the castle nut 340 comprises a second plurality of apertures 343. According to some embodiments presently disclosed, the first plurality of apertures 347 is positioned directly across from the second plurality of apertures 343. According to some embodiments presently disclosed, one or more apertures 347 are positioned directly across from one or more apertures 343. According to some embodiments presently disclosed, the first plurality of apertures 347 is not positioned directly across from the second plurality of apertures 343. According to some embodiments presently disclosed, one or more apertures 347 are not positioned directly across from one or more apertures 343. According to some embodiments presently disclosed, at least one of the apertures 347 is positioned across from and between two adjacent apertures 343. According to some embodiments presently disclosed, the castle nut 340 comprises a second width from the rear end 367 to the forward end 363. According to some embodiments presently disclosed, the castle nut 340 comprises a second distance from the rear end 367 to the forward end 363.

According to some embodiments presently disclosed, the staking fixture 250 is pushed along the buffer tube 20 until the one or more protrusions 260 are positioned within the apertures 343 of the castle nut 340. According to some embodiments presently disclosed, the aperture 278 of the rearward protrusion 276 is positioned above at least a portion of the end plate 35 when the one or more protrusions 260 are positioned within the apertures 343 of the castle nut 340.

Placing a staking punch 79 or 99 into the aperture 278 positions the staking punch 79 or 99 above at least a portion of the end plate 35. Applying a striking force (for example, with a hammer), to the staking punch 79 or 99, deforms a portion 81 of the end plate 35, causing a portion of the end plate 35 to move into at least one of the apertures 347. According to some embodiments presently disclosed, the portion of the end plate 35 that is positioned in the aperture 347 prevents the castle nut from rotating away from the end plate 35. According to some embodiments presently disclosed, the staking fixture 250 may be repositioned, allowing a user to cause multiple deformations portions 81 along the end plate 35.

According to some embodiments presently disclosed, the second width of the castle nut 340 is greater than the first width of the castle nut 240. According to some embodiments presently disclosed, the second distance of the castle nut 340 is greater than the first distance of the castle nut 240. According to some embodiments presently disclosed, the rearward protrusion 276 is configured to accommodate the second distance of the castle nut 340. According to some embodiments presently disclosed, the forward protrusion 275 is configured to accommodate the first distance of the castle nut 240. According to some embodiments presently disclosed, the rearward protrusion 276 is configured to accommodate the second width of the castle nut 340. According to some embodiments presently disclosed, the forward protrusion 275 is configured to accommodate the first width of the castle nut 240.

Referring to FIGS. 25-31, a staking fixture 450 is shown according to some embodiments presently disclosed. The staking fixture 450 comprises a front surface 451 and a rear surface 453. According to some embodiments presently disclosed, a main body 476 of the staking fixture 450 comprise one or more apertures 405. According to some embodiments presently disclosed, the one or more apertures 405 are elongated. According to some embodiments presently disclosed, the one or more apertures 405 are elongated channels. According to some embodiments presently disclosed, the one or 27 more apertures 405 are elongated channels that are semicircular. According to some embodiments presently disclosed, the staking fixture 450 defines the one or more apertures 405.

The staking fixture 450 further comprises an opening 455 configured to accommodate at least a portion of the circumference of the castle nuts 40 240 and/or 340. According to some embodiments presently disclosed, the opening 555 is semicircular. According to some embodiments presently disclosed, the staking fixture 450 defines the opening 455. According to some embodiments presently disclosed, the staking fixture 450 forms the opening 455.

According to some embodiments presently disclosed, the staking fixture 450 comprises one or more protrusions 460 extending into the opening 455 (shown in FIG. 25-31). According to some embodiments presently disclosed, the second plurality of apertures 43 of the castle nut 40 are configured to accommodate the one or more protrusions 460 of the staking fixture 450. According to some embodiments presently disclosed, the one or more protrusions 460 of the staking fixture 450 lineup with the second plurality of apertures 43 of the castle nut 40. According to some embodiments presently disclosed, the second plurality of apertures 243 of the castle nut 240 are configured to accommodate the one or more protrusions 460 of the staking fixture 450. According to some embodiments presently disclosed, the one or more protrusions 460 of the staking fixture 450 lineup with the second plurality of apertures 243 of the castle nut 240. According to some embodiments presently disclosed, the second plurality of apertures 343 of the castle nut 340 are configured to accommodate the one or more protrusions 460 of the staking fixture 450. According to some embodiments presently disclosed, the one or more protrusions 460 of the staking fixture 450 lineup with the second plurality of apertures 343 of the castle nut 340.

According to some embodiments presently disclosed, the staking fixture 450 comprises an adjustable guide 475 removably coupled with the main body 476 of the staking fixture 450. The adjustable guide 475 comprises an aperture 477 configured to accommodate the staking punch 79 or 199.

According to some embodiments presently disclosed, the staking fixture 450 is pushed along the buffer tube 20 until the one or more protrusions 460 are positioned within the apertures 43 of the castle nut 40. According to some embodiments presently disclosed, the aperture 477 of the adjustable guide 475 is positioned above at least a portion of the end plate 35 when the one or more protrusions 460 are positioned within the apertures 43 of the castle nut 40.

Placing a staking punch 79 or 99 into the aperture 477 positions the staking punch 79 or 99 above at least a portion of the end plate 35. Applying a striking force (for example, with a hammer), to the staking punch 79 or 99, deforms a portion 81 of the end plate 35, causing a portion of the end plate 35 to move into at least one of the apertures 47 (shown in FIGS. 11-12). According to some embodiments presently disclosed, the portion of the end plate 35 that is positioned in the aperture 47 prevents the castle nut from rotating away from the end plate 35. According to some embodiments presently disclosed, the staking fixture 450 may be repositioned, allowing a user to cause multiple deformations portions 81 along the end plate 35. According to some embodiments presently disclosed, the adjustable guide 475 may be repositioned along the main body 476, allowing a user to cause multiple deformations portions 81 along the end plate 35.

According to some embodiments presently disclosed, a castle nut 540 is shown in FIGS. 25-28. The castle nut 540 comprises a forward end 563 and a rear end 567. According to some embodiments presently disclosed, the forward end 563 of the castle nut 540 comprises a first plurality of apertures 547. According to some embodiments presently disclosed, the rear end 567 of the castle nut 540 comprises a second plurality of apertures 543. According to some embodiments presently disclosed, the first plurality of apertures 547 is positioned directly across from the second plurality of apertures 543. According to some embodiments presently disclosed, one or more apertures 547 are positioned directly across from one or more apertures 543.

According to some embodiments presently disclosed, the first plurality of apertures 547 is not positioned directly across from the second plurality of apertures 543. According to some embodiments presently disclosed, one or more apertures 547 are not positioned directly across from one or more apertures 543. According to some embodiments presently disclosed, at least one of the apertures 547 is positioned across from and between two adjacent apertures 543.

Figure 27:
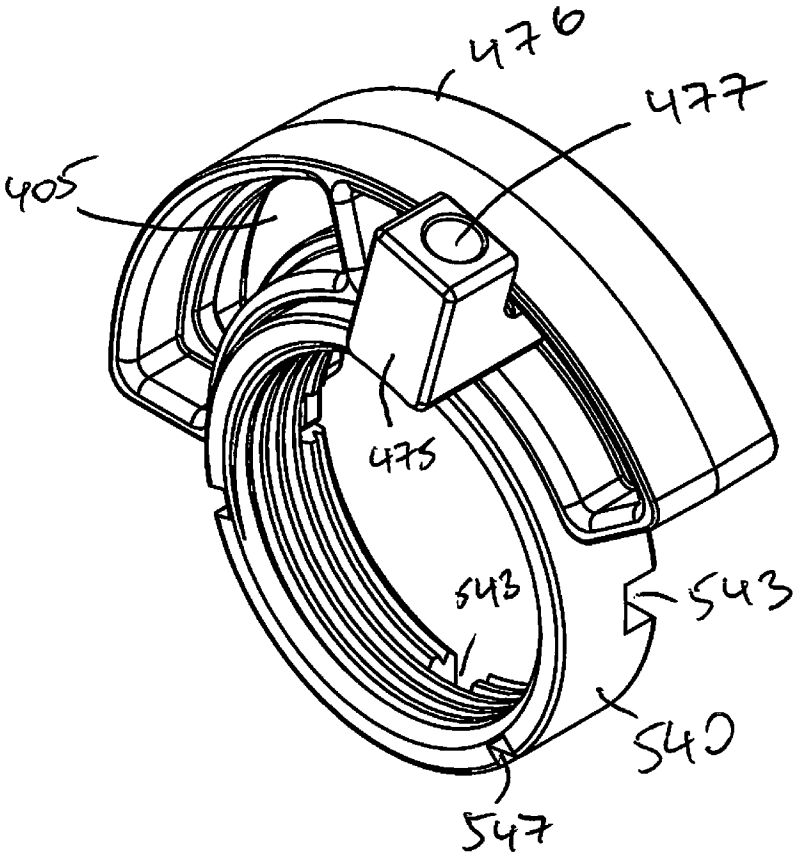
FIG. 27 depicts another perspective view of the stacking fixture according to some embodiments presently disclosed.
Figure 28:
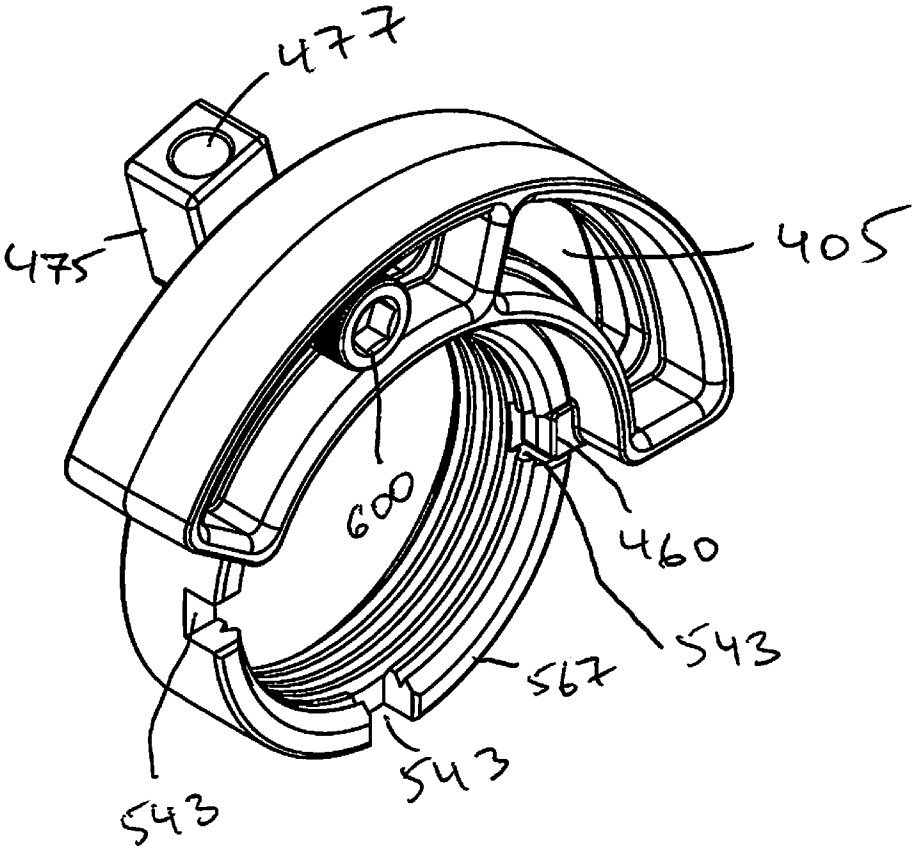
FIG. 28 depicts another perspective view of the stacking fixture according to some embodiments presently disclosed.
Figure 29:
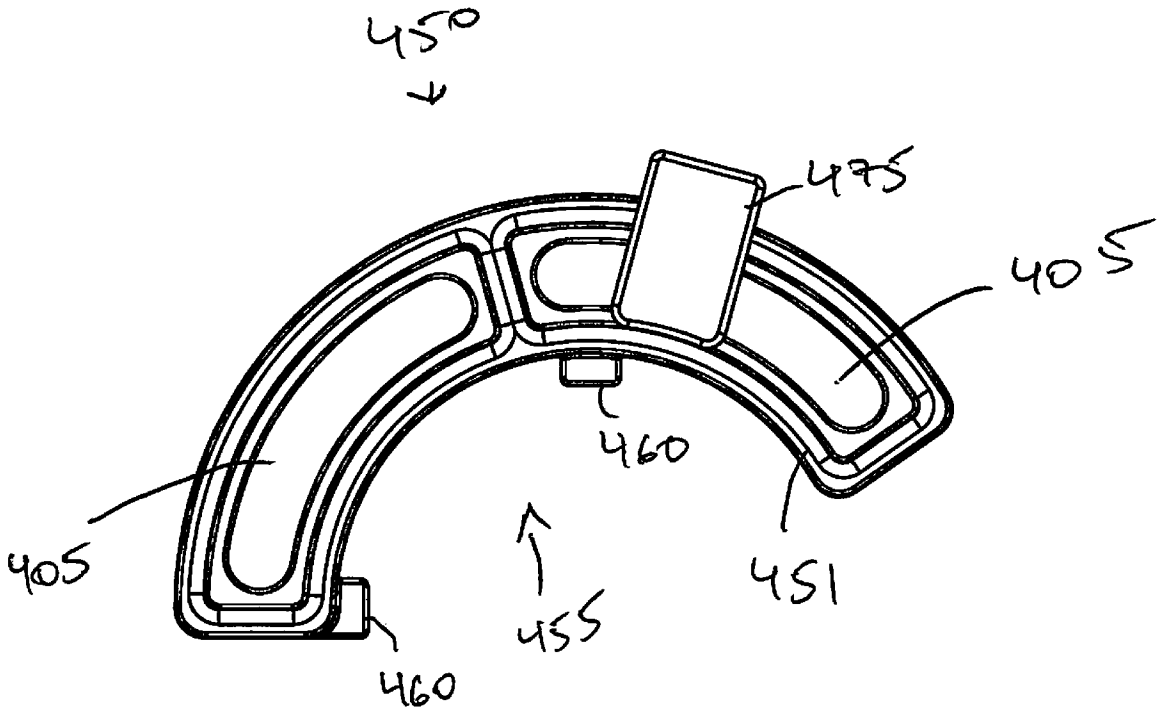
FIG. 29 depicts a front view of the stacking fixture according to some embodiments presently disclosed.

According to some embodiments presently disclosed, the staking fixture 450 is pushed along the buffer tube 20 until the one or more protrusions 460 are positioned within the apertures 543 of the castle nut 540 (shown in FIGS. 27-28). According to some embodiments presently disclosed, the aperture 577 of the adjustable guide 475 is positioned above at least a portion of the end plate 35 when the one or more protrusions 460 are positioned within the apertures 543 of the castle nut 540.

Placing a staking punch 79 or 99 into the aperture 477 positions the staking punch 79 or 99 above at least a portion of the end plate 35. Applying a striking force (for example, with a hammer), to the staking punch 79 or 99, deforms a portion 81 of the end plate 35, causing a portion of the end plate 35 to move into at least one of the apertures 547. According to some embodiments presently disclosed, the portion of the end plate 35 that is positioned in the aperture 547 prevents the castle nut from rotating away from the end plate 35. According to some embodiments presently disclosed, the staking fixture 450 may be repositioned, allowing a user to cause multiple deformations portions 81 along the end plate 35. According to some embodiments presently disclosed, the adjustable guide 475 may be repositioned along the main body 476, allowing a user to cause multiple deformations portions 81 along the end plate 35.

According to some embodiments, the adjustable guide 475 is removably coupled with the main body 476 with one or more fasteners 600. According to some embodiments, the adjustable guide 475 comprises an aperture 605 configured to accommodate the fastener 600. According to some embodiments, the aperture 605 comprises thread configured to accommodate thread 610 of the fastener 600.

Figure 30:
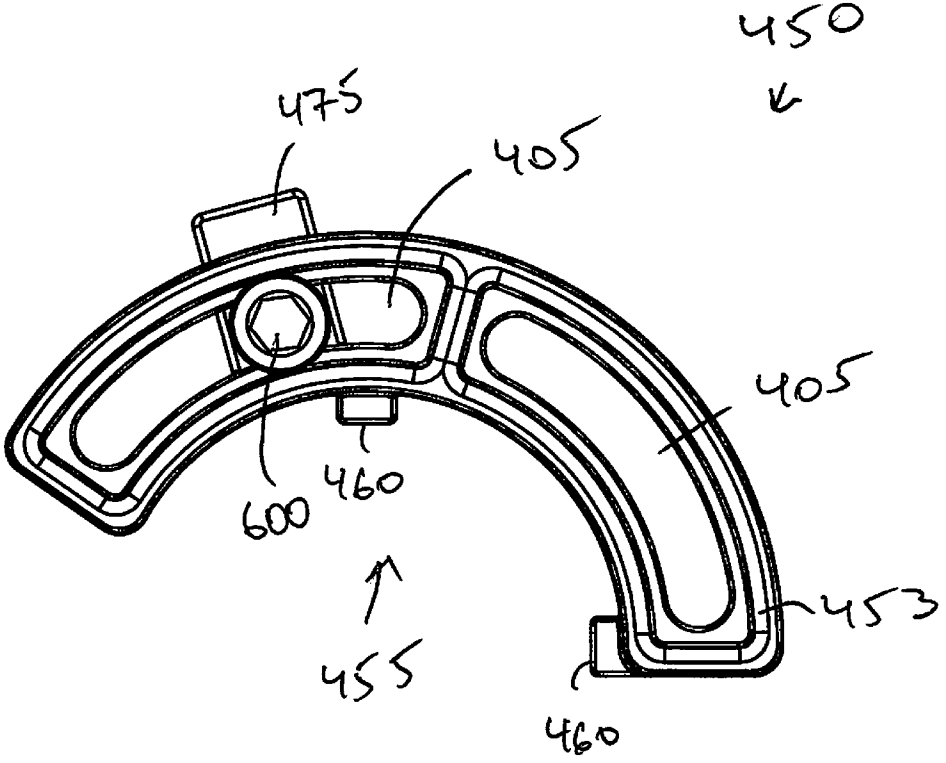
FIG. 30 depicts a rear view of the stacking fixture according to some embodiments presently disclosed.
Figure 31:
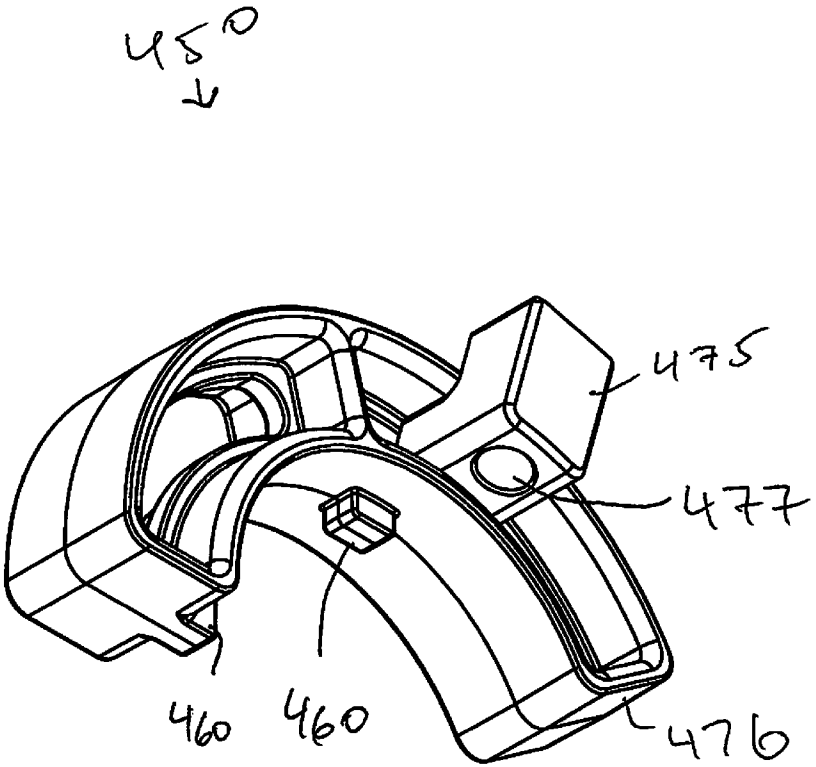
FIG. 31 depicts a perspective, bottom view of the stacking fixture according to some embodiments presently disclosed.

According to some embodiments, the one or more apertures 405 are configured to accommodate the one or more fasteners 600 (shown in FIGS. 28 and 30). According to some embodiments, the fastener 600 is positioned through the one or more apertures 405 and coupled with the adjustable guide 475. According to some embodiments, the adjustable guide 475 may be coupled with the main body 476 along any location in the one or more apertures 405.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A staking fixture comprising:

a front surface;

a rear surface;

an opening;

a plurality of protrusions extending into the opening; and a forward protrusion extending away from the front surface, wherein the forward protrusion comprises an aperture configured to accommodate a staking punch.

2. The staking fixture of claim 1 further comprising:

a rearward protrusion extending away from the rear surface, wherein the rearward protrusion comprises another aperture configured to accommodate the staking punch.

3. The staking fixture of claim 1 wherein the forward protrusion is adjustable.

4. The staking fixture of claim 1 wherein the forward protrusion is removably coupled with the staking fixture.

* * * * *